US010938105B2

(12) United States Patent
Snyder et al.

(10) Patent No.: US 10,938,105 B2
(45) Date of Patent: Mar. 2, 2021

(54) CONFORMAL MULTI-BAND ANTENNA STRUCTURE

(71) Applicant: Anderson Contract Engineering, Inc., Apopka, FL (US)

(72) Inventors: Christopher Snyder, Melbourne, FL (US); Brian Anderson, Apopka, FL (US)

(73) Assignee: Anderson Contract Engineering, Inc., Apopka, FL (US)

( * ) Notice: Subject to any disclaimer, the term of this patent is extended or adjusted under 35 U.S.C. 154(b) by 92 days.

(21) Appl. No.: 15/789,983

(22) Filed: Oct. 21, 2017

(65) Prior Publication Data

US 2018/0166781 A1 Jun. 14, 2018

Related U.S. Application Data

(60) Provisional application No. 62/411,204, filed on Oct. 21, 2016.

(51) Int. Cl.

| | |
|---|---|
| ***H01Q 1/28*** | (2006.01) |
| ***H01Q 3/46*** | (2006.01) |
| ***H01Q 21/06*** | (2006.01) |
| ***H01Q 5/357*** | (2015.01) |
| ***H01Q 21/08*** | (2006.01) |
| ***H01Q 19/19*** | (2006.01) |
| ***H01Q 15/14*** | (2006.01) |
| ***H01Q 5/30*** | (2015.01) |
| ***H01Q 19/13*** | (2006.01) |
| *H01Q 21/29* | (2006.01) |
| *H01Q 1/42* | (2006.01) |

(52) U.S. Cl.

CPC ..... *H01Q 3/46* (2013.01); *H01Q 1/282* (2013.01); *H01Q 1/286* (2013.01); *H01Q 1/287* (2013.01); *H01Q 5/30* (2015.01); *H01Q 5/357* (2015.01); *H01Q 15/148* (2013.01); *H01Q 19/132* (2013.01); *H01Q 19/193* (2013.01); *H01Q 21/065* (2013.01); *H01Q 21/08* (2013.01); *H01Q 1/42* (2013.01); *H01Q 21/296* (2013.01)

(58) Field of Classification Search

CPC .. H01Q 1/27; H01Q 1/28; H01Q 1/34; H01Q 1/40; H01Q 1/42; H01Q 1/281; H01Q 1/282; H01Q 1/285; H01Q 1/286; H01Q 1/287; H01Q 1/3275; H01Q 21/00; H01Q 21/296; H01Q 21/08; H01Q 21/065; H01Q 15/148; H01Q 3/46; H01Q 19/132; H01Q 19/193; H01Q 5/30; H01Q 5/357

See application file for complete search history.

(56) References Cited

U.S. PATENT DOCUMENTS 5,053,781 A * 10/1991 Milman ..... G01K 11/006 342/351

6,774,848 B2 * 8/2004 Wright ..... H01Q 1/286 343/700 MS (Continued)

*Primary Examiner* — Awat M Salih

(74) *Attorney, Agent, or Firm* — RM Reed Law PLLC

(57) ABSTRACT

In some embodiments, an antenna may include a plurality of reflectarray tiles and a frame including a plurality of frame elements coupled electrically and mechanically. The frame may be configured to conform to a shape of a surface. Each frame element may be configured to receive one of the plurality of reflectarray tiles. In some aspects, the plurality of reflectarray tiles may be illuminated directly or indirectly by a feed.

20 Claims, 15 Drawing Sheets

(56) References Cited

U.S. PATENT DOCUMENTS

| | | | | |
|---|---|---|---|---|
| 8,334,809 | B2 * | 12/2012 | Nichols | H01Q 1/3275 343/700 MS |
| 2003/0020666 | A1 * | 1/2003 | Wright | H01Q 1/286 343/824 |
| 2008/0316124 | A1 * | 12/2008 | Hook | H01Q 21/062 343/705 |
| 2010/0194640 | A1 * | 8/2010 | Navarro | G01S 7/006 342/372 |
| 2010/0309089 | A1 * | 12/2010 | Collinson | H01Q 1/42 343/872 |
| 2013/0162490 | A1 * | 6/2013 | Blech | H01Q 3/2676 343/754 |
| 2015/0015453 | A1 * | 1/2015 | Puzella | H01Q 21/0025 343/853 |
| 2015/0303586 | A1 * | 10/2015 | Hafenrichter | H01Q 1/40 343/873 |
| 2016/0156099 | A1 * | 6/2016 | Kim | H01Q 21/061 342/359 |
| 2017/0184716 | A1 * | 6/2017 | Bini | A61B 8/4483 |

* cited by examiner

CONFORMAL MULTI-BAND ANTENNA STRUCTURE

CROSS-REFERENCE TO RELATED APPLICATION(S)

The present application is a non-provisional of and claims priority to U.S. Provisional Patent Application No. 62/411,204 filed on Oct. 21, 2016 and entitled "Conformal Multi-Band Antenna Structure", which is incorporated herein by reference in its entirety.

FIELD

The present disclosure is generally related to satellite communications antenna systems for aircraft and terrestrial vehicles operating in the Ku-band, Ka-band, or both.

BACKGROUND

In recent years, airlines have attempted to expand in-flight entertainment capabilities, such as by adding in-flight television and, in some instances, in-flight Internet access. To provide such services, the airplane includes an antenna configured to send and receive signals to and from a satellite.

In general, the antenna size may be limited by gimbal under radome configurations due to drag, fuel costs, bird impacts, and other factors. Conventionally, one approach involves using a two-axis gimbal to move the antenna. The external radome can limit the available volume for the antenna system. While larger antennas could produce a larger gain, the radome imposes some size restrictions. Additionally, having a gimbal move the aperture through a larger volume limits the space for the actual aperture, which also limits the gain. The expense for designing and then certifying another radome to allow for a larger antenna would be cost prohibitive and may also add to issues with respect to reliability, maintenance, and life cycle costs.

SUMMARY

In certain embodiments, an apparatus may include a modular antenna structure or frame configured to receive a plurality of reflective element cells adapted to conform to an exterior surface of an aircraft. The plurality of reflective element cells cooperate with the modular antenna structure to provide a reflectarray having one or more reflective surfaces, which may be terminated with a controllable phase over an area to provide a desired beam formation.

In certain embodiments, a frame includes a plurality of frame elements configured to couple to a surface and configured to accept a corresponding plurality of reflect element cells to produce a reflectarray, which may be illuminated with a horn, an array, a sub-reflector, or some other source to provide electromagnetic radiation toward the surface. The frame provides a mechanical structure as well as electrical interconnects.

In some embodiments, a communication system may include a frame formed from a plurality of frame elements. Each frame element may be configured to receive a reflective element cell. The frame and the reflective element cells may be configurable.

BRIEF DESCRIPTION OF THE DRAWINGS

The novel features of this disclosure can best be understood from the accompanying drawings, taken in conjunction with the accompanying description. The drawings are provided for illustrative purposes only, and are not necessarily drawn to scale.

In the following discussion, the same reference numbers are used in the various embodiments to indicate the same or similar elements.

DETAILED DESCRIPTION OF ILLUSTRATIVE EMBODIMENTS

Figure 1:
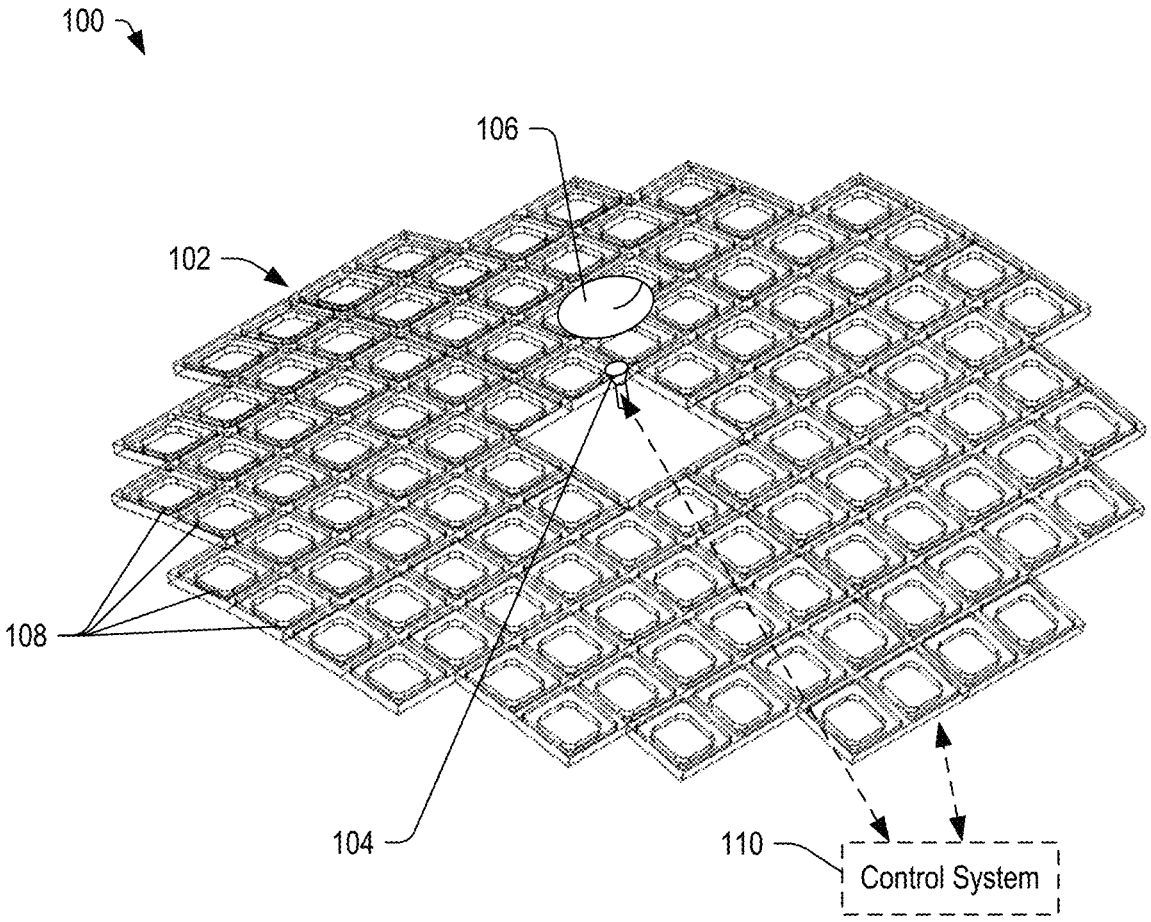
FIG. 1 depicts a conformal antenna system including an unpopulated frame, a feed, and a sub-reflector, in accordance with certain embodiments of the present disclosure.

Embodiments of a satellite communications antenna system are described below, which may include a frame formed from a plurality of frame elements, each of which may be configured to physically secure and electrically couple to a reflectarray tile. In some embodiments, the frame elements are modular and may be coupled to adjacent frame elements to form an array of frame elements, which may be referred to as a frame or an antenna frame. In some embodiments, the frame may secure a plurality of reflectarray tiles to provide a reflectarray that can be configured for single band or multi-band satellite communications, including microwave signals.

As used herein, the term "microwave" signals refers to electromagnetic radiation having wavelengths in a range from one meter to one millimeter and frequencies in a range between approximately 300 Megahertz (MHz) and 300 Gigahertz (GHz). The antenna devices described herein may be configured to receive microwave signals in the C-band (4 to 8 GHz), X-band (8 to 12 GHz), K-band (18 to 26.5 GHz), Ka-band (26.5 to 40 GHz), Ku-band (12 to 18 GHz), other microwave frequency bands, or any combination thereof. Such bands of the microwave spectrum may be used for long-distance radio telecommunications, satellite communications, radar, terrestrial broadband, space communications, amateur radio, automotive radar, and the like.

Embodiments of a conformal multi-band antenna structure are described below that may be configured for use with aircraft or terrestrial vehicles and that may be configured to send microwave signals, to receive microwave signals, or both and operate on such signals in the Ku-band, the Ka-band, or any combination thereof. Further, embodiments of the conformal multi-band antenna structure may be used in static installations for low earth orbit (LEO) or medium earth orbit (MEO) satellite tracking or other embodiments where the platform is fixed and the signal source is moving. The structure may include a frame configured to conform to a surface to which the frame is attached and configured to accept one or more reflectarray tiles, which can be illuminated by an antenna feed. The frame may provide both a mechanical structure for securing the reflectarray tiles and an electrical interconnect for coupling to an antenna aperture of each reflectarray tile. The frame may also be electrically coupled to one or more systems within the frame, within the underlying structure, or any combination thereof.

In certain embodiments, the electrical interconnections may deliver power and digital command signals to the reflectarray tiles. The digital command signals may be used to control the reflectarray tiles, and the command signals may be addressed to specific tiles of the array, making the tiles independently addressable and controllable.

In some embodiments, the frame may be conformal, such that the frame corresponds to the shape of the underlying surface. Further, the frame may have a low profile such that the frame and the corresponding reflectarray tiles do not undermine the airflow characteristics of the underlying surface. One possible example of a conformal frame for an antenna system is described below with respect to FIG. 1.

FIG. 1 depicts a conformal antenna system 100 including an unpopulated frame 102, a feed 104, and a sub-reflector 106, in accordance with certain embodiments of the present disclosure. The term "unpopulated" in this context refers to the absence of reflectarray tiles. The frame 102 may include a plurality of frame elements 108, which may be physically and electrically coupled along adjacent edges to produce an array of frame elements, which array may be referred to as the frame 102. Each frame element 108 may include a frame coupling interface that physically and electrically couples a first frame to an adjacent frame and may include a reflectarray tile interface configured couple the antenna aperture to the frame element 108. In some embodiments, the frame 102 may be modular, such that antenna elements 108 may be added or removed to provide a frame 102 having a selected size.

Each frame element 108 may be configured to receive a reflectarray tile, which may be configured to provide electronic beam-forming and beam-pointing functions. Each reflectarray tile may include a plurality of reflective element cells (RECs) in a matrix of rows (M) and columns (N) (i.e., an M×N matrix). The reflectarray tiles may be single-band or multi-band, depending on the implementation.

In some embodiments, the frame 102 and the feed 104 may be coupled to a control system 110 to provide power, data, control signals, or any combination thereof. The control system 110 may be a computing system associated with an aircraft or an automobile. In certain embodiments, the control system 110 may control the reflection phase of one or more of the reflectarray tiles, or RECs of a selected reflectarray tile, or any combination thereof.

In some embodiments, the frame 102 may provide a modular attachment structure that can be sized by adding or removing frame elements 108 to achieve a selected array size. The frame 102 simplifies the installation and subsequent servicing or replacement of reflectarray tiles to provide communication of text, images, video, audio, and other data between the array and a microwave signal source, such as a satellite. Once the frame 102 is coupled to a surface, such as the exterior surface of an aircraft or a vehicle, individual reflectarray tiles may be coupled to individual frame elements 108 to produce a reflectarray that can operate in conjunction with single or multiple feed horns or a phased array feed to provide communications with one or more satellites.

In the illustrated example, the frame elements 108 are substantially rectangular or more specifically square; however, the shape of the frame elements 108 may be varied to correspond to the shape of the reflectarray tiles. If the tiles are formed with a different shape, the frame may be configured to have a corresponding shape to receive and mechanically secure the tiles. Accordingly, the frame elements 108 may be formed to the shape of any regular polygon or another geometric shape that facilitates the tessellation of the frame surface.

In FIG. 1, the feed 104 may be spaced apart from the frame 102 by a distance to provide sufficient focal length, as is typical of single or dual reflector antenna systems. In some configurations, the feed 104 may directly illuminate the reflectarray surface, such as in a parabolic reflector antenna. In other configurations, the feed 104 may illuminate the reflectarray by means of a sub reflector, as in a Cassegrain reflector configuration, a Gregorian reflector configuration, or displaced axis/ring focus variants of either configuration. In still other configurations, the feed 104 may be protected from the environment in a radome specific to that purpose or integrated within a feature of the vehicle, such as a vertical stabilizer of an aircraft. Regardless of the feed 104 configuration, the frame elements 108 may be coupled to one another along edges to form the frame 102, and the frame 102 may be mounted to the surface (such as by screws, bolts, weld points, rivets, Hi-Lok™ pins, other common aircraft hardware, or any combination thereof) and to provide a structure to which the reflectarray tiles may be coupled.

In some embodiments, the control system 110 may be coupled to the RF feed 104, to the frame 102, and to each tile within the frame 102. One possible example of a system including the control system 110 coupled to an active reflectarray antenna (ARA) that can be implemented as a conformal antenna system is described below with respect to FIG. 2.

Figure 2:
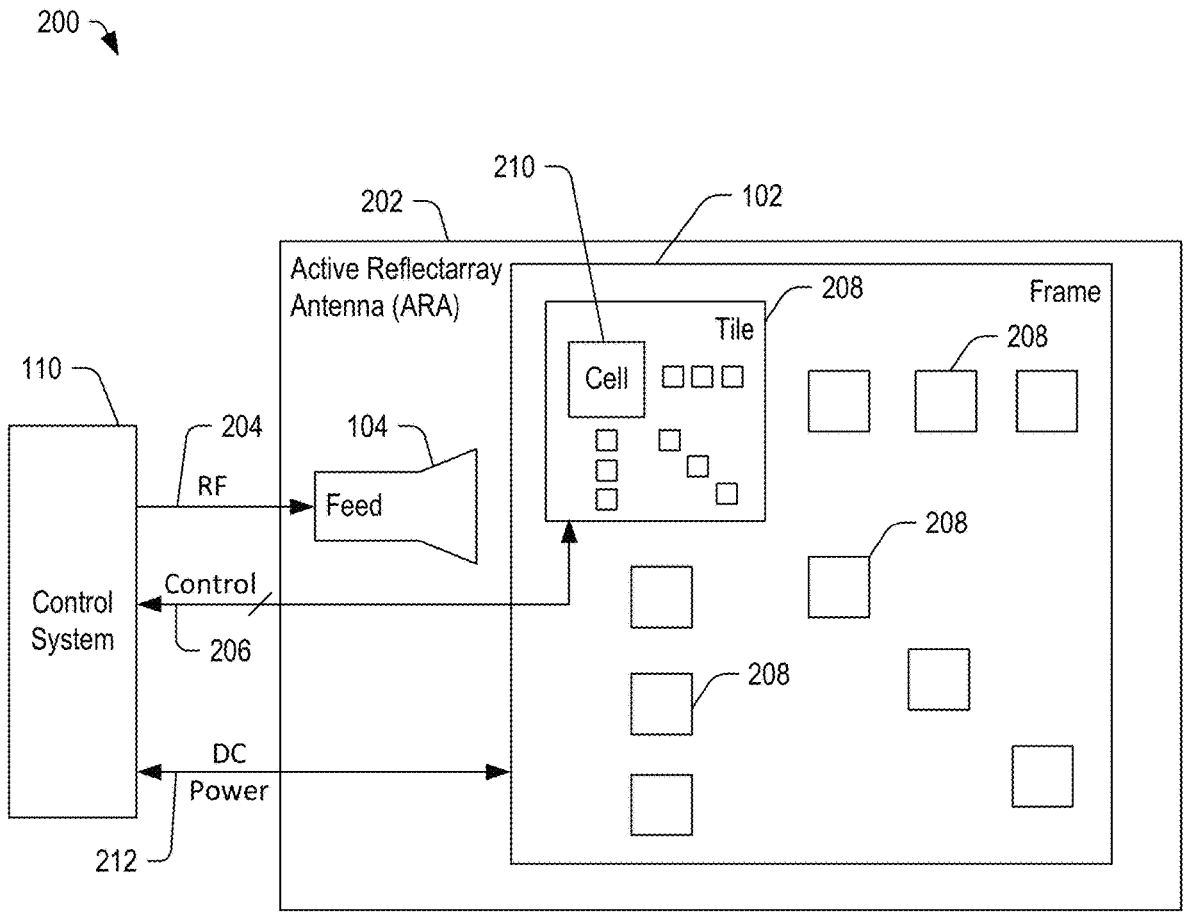
FIG. 2 depicts a block diagram of an active reflectarray antenna system that can be implemented as a conformal antenna system, in accordance with certain embodiments of the present disclosure.

FIG. 2 depicts a block diagram of an ARA system 200 that can be implemented as a conformal antenna system, in accordance with certain embodiments of the present disclosure. The ARA system 200 may include an active reflectarray antenna 202 coupled to the control system 110. The active reflectarray antenna 202 may include the frame 102, and the feed 104 of FIG. 1. Further, the active reflectarray antenna 202 may include a plurality of tiles 208 mounted within the frame 102. Each tile 208 may include a plurality of cells 210.

In some embodiments, the control system 110 may provide radio frequency (RF) signals to the feed 104 via a first communication link 204, which may be a wired connection. The control system 110 may further provide control signals to one or more of the tiles 208 (and optionally to individual cells 210 of each tile 208) via one or more control lines 206. Additionally, the control system 110 may be configured to provide direct current (DC) power to the frame 102 and to each tile 208 and cell 210 through a power bus 212. Other embodiments are also possible.

It should be understood that the feed 104 provides both transmit and receive functionality to the array of reflectors (tiles 208) within the array 202. The frame 102 provides support for a sub-array of tiles 208. Each tile 208 includes a discreet number of reflective element cells 210. Each cell 210 controls the reflection phase of a single sample area.

Figure 3:
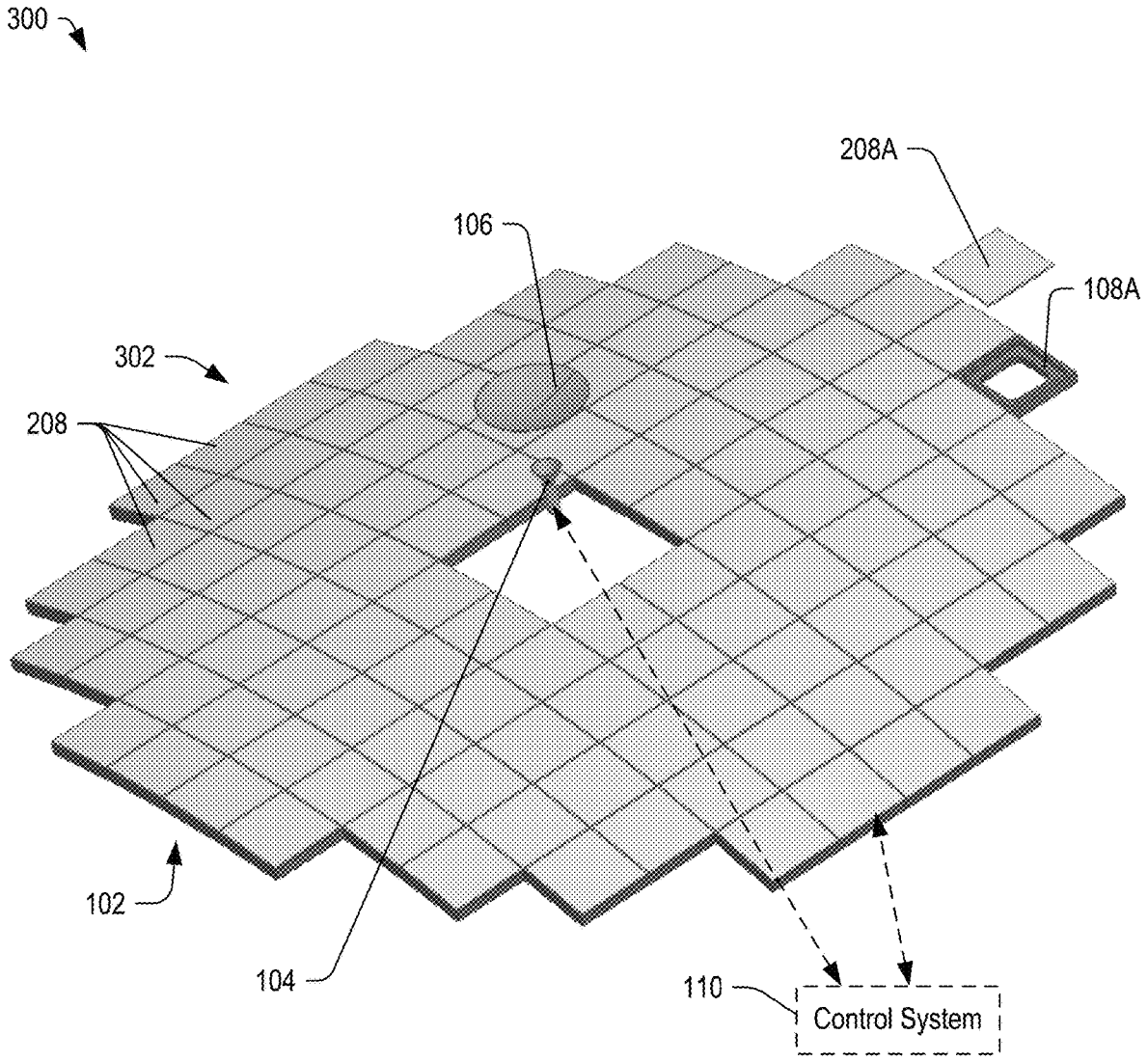
FIG. 3 depicts a conformal antenna system including a frame populated with reflective element cells and with one reflectarray tile removed to expose a corresponding frame element, in accordance with certain embodiments of the present disclosure.

FIG. 3 depicts a conformal antenna system 300 including a frame 102 populated with reflectarray tiles 208 and with one reflectarray tile 208A removed to expose a corresponding frame element 108A of the frame 102, in accordance with certain embodiments of the present disclosure. The populated frame 102 may be called an antenna 302. In some embodiments, each frame element 108 may be configured to receive and secure the reflectarray tile 208 and to provide an electrical connection between the reflectarray tile 208 and the control system 110.

The frame 102 may secure the antenna reflectarray tiles 208 in a contoured configuration that conforms to the mounting surface, such as an exterior surface of an airplane. The frame 102 may provide mechanical registration and alignment to a known physical geometry. In some embodiments, the frame 102 may provide a low profile of approximately one inch or less relative to the exterior surface. Further, the frame 102 may provide data matrix markings for each tile mounting location to facilitate assembly, testing, and maintenance. The control system 110 or a microcontroller of each tile 208 may read frame configuration information directly, such as from a multi-dimensional bar code, which may include a frame part number, revision data, location data, and so on. In some embodiments, the frame 102 distributes power to each tile 208 using, for example, a blind mate connector that meets environmental requirements. In other embodiments, power may be distributed to at least one of the frame 102 and the tiles 208 using a wireless power transfer, such as by direct contact near field inductive coupling or environmental sealed coils integral to the frame 102.

In the illustrated example, each reflectarray tile 208 may include a plurality of cells 210 in a matrix of rows and columns, such as an M×N matrix. Any number of reflectarray tiles 208 may be included, depending on the implementation. Individual reflectarray tiles 208 may have a fixed time delay, which can be used in a manner consistent with coarse geometry correction of the desired electrical configuration. Reflection phase may be controlled in response to control signals from the control system 110 to point the antenna array 302 at a desired signal source, such as a satellite.

In some embodiments, the reflectarray tiles 208 may be single-band or multi-band. The frame 102 can be populated with tile variants consistent with the required aperture. In an example, lower frequency coverage may require a larger aperture as compared to that of a higher frequency for equivalent directivity. In some examples, the tile population distribution can be reconfigurable to meet requirements of a location where a particular antenna may be utilized, such as for aircraft routes that present different look angles to a given satellite or to alternate satellite service providers. The cells 210 in multi-band tiles 208 can be vertically stacked and at a different lattice spacing to meet spatial sampling requirements. Other embodiments are also possible.

In FIG. 3, the tiles 208, the frame 102, and the electrical interconnects may be seal from the environment. Further, the feed 104 and the sub-reflector 106 may be enclosed within a radome to form a feed assembly. In such an embodiment, the antenna 302 may be provided without an overarching radome.

In the illustrated examples of FIGS. 1 and 3, the feed 104 provides illumination to the surface of the reflect antenna array 302. The feed 104 may be a single feed horn or may include multiple feeds to provide a selected frequency coverage. In some embodiments, the feed 104 may include a phased array feed configured to provide compact defocused optics and multi-beam simultaneous or switched coverage to multiple satellites. In some embodiments, a center-fed or offset geometry may offer a basic implementation. Potential configurations may also include a Cassegrain or Gregorian configuration or even a displaced axis/ring focus. In some embodiments, the array 302 may be fed by a phased array that provides feed pattern agility and that may improve vehicle integration.

In the illustrated examples of FIGS. 1 and 3, the feed 104 may be offset from the frame 102 by a distance to provide sufficient focal length, which may be typical of a single or dual reflector antenna system. As mentioned above, in some configurations, the feed 104 may directly illuminate the reflectarray surface, such as in a parabolic reflector antenna. In other configurations, the feed 104 may illuminate the reflectarray by means of a sub reflector, as in a Cassegrain reflector configuration, a Gregorian reflector configuration, or displaced axis/ring focus variants of either configuration. In still other configurations, the feed 104 may be protected from the environment in a radome specific to that purpose or integrated within a feature of the vehicle, such as a vertical stabilizer of an aircraft. Other embodiments are also possible.

Figure 4A:
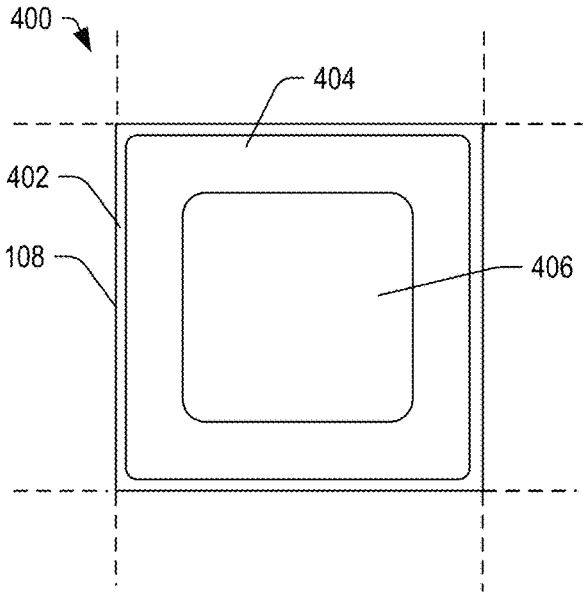
FIG. 4A depicts an enlarged view of a frame element, in accordance with certain embodiments of the present disclosure.

FIG. 4A depicts an enlarged view 400 of a frame element 108, in accordance with certain embodiments of the present disclosure. The frame element 108 may include a sidewall 402, which may include electrical interconnections as well as physical connection elements configured to couple the frame element 108 to adjacent frame elements electrically and mechanically. Further, the frame element 108 may include a recessed portion 404 inset from the sidewall 402 and configured to engage a surface of a reflectarray tile 208. The frame element 108 may further include an opening 406. The opening 406 may provide a dual purpose of allowing for additional space for circuitry or interconnects beneath the reflectarray tile 208 as well as reducing the overall weight of the frame 102.

Figure 4B:
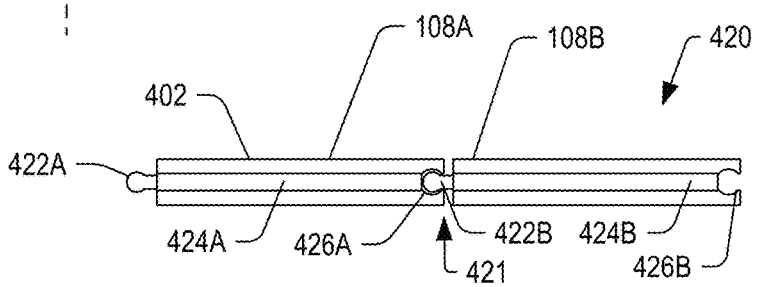
FIG. 4B depicts a side view of two frame elements coupled by an attachment feature, in accordance with certain embodiments of the present disclosure.

FIG. 4B depicts a side view 420 of two frame elements 108 coupled by an attachment feature 421, in accordance with certain embodiments of the present disclosure. It should be appreciated that the attachment feature 421 represents one possible coupling mechanism for mechanically and electrically coupling adjacent frame elements 108A and 108B. Other coupling mechanisms are also possible.

In the illustrated example, the frame element 108 may include a protrusion or extension 422 on two edges and a groove or slot 424 and 426 on two edges. A protrusion 422B of a second frame element 108B may be inserted or slid into the slot 426A of the first frame element to couple frame elements 108A and 108B along one edge. A slot 424A may be provided along another edge of the frame element 108A. Similarly, another protrusion (not shown) may be provided on the fourth edge of the frame element 108A.

In some examples, frame elements 108 may be mechanically and electrically coupled to at least one adjacent frame element 108 along one edge and may be coupled to other frame elements 108 along other edges. The frame elements 108 may be coupled together to form an M×N array. The mechanical connection between adjacent frame elements 108 may be adjustable to allow the frame 102 (formed by the matrix of frame elements 108) to curve or conform to an underlying surface.

Figure 4C:
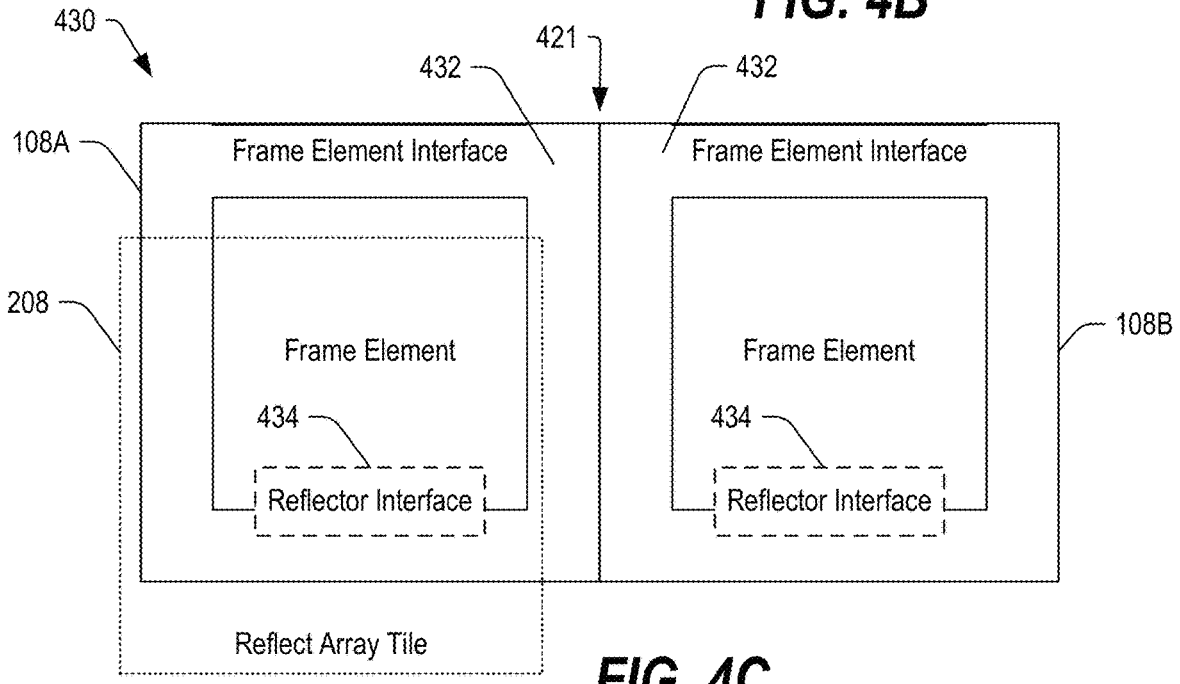
FIG. 4C illustrates a top view of two frame elements coupled by an attachment feature and including a frame element interface, in accordance with certain embodiments of the present disclosure.

FIG. 4C illustrates a top view 430 of two frame elements 108A and 108B coupled by an attachment feature 421 and including a frame element interface 432, in accordance with certain embodiments of the present disclosure. Each frame element 108A and 108B may include a corresponding frame element interface 432, which may provide electrical connections between adjacent frame elements 108 and optionally to a frame bus (shown in FIG. 6), which may couple the frame elements 108 electrically, communicatively, or both.

Further, each frame element 108A and 108B may include a reflector interface 434. The reflector interface 434 may operate to electrically couple a reflectarray tile 208 to the frame element 108. In some embodiments, the frame element 108 may include circuitry configured to couple the reflector interface 434 to the frame element interface 432, and vice versa.

Figure 5:
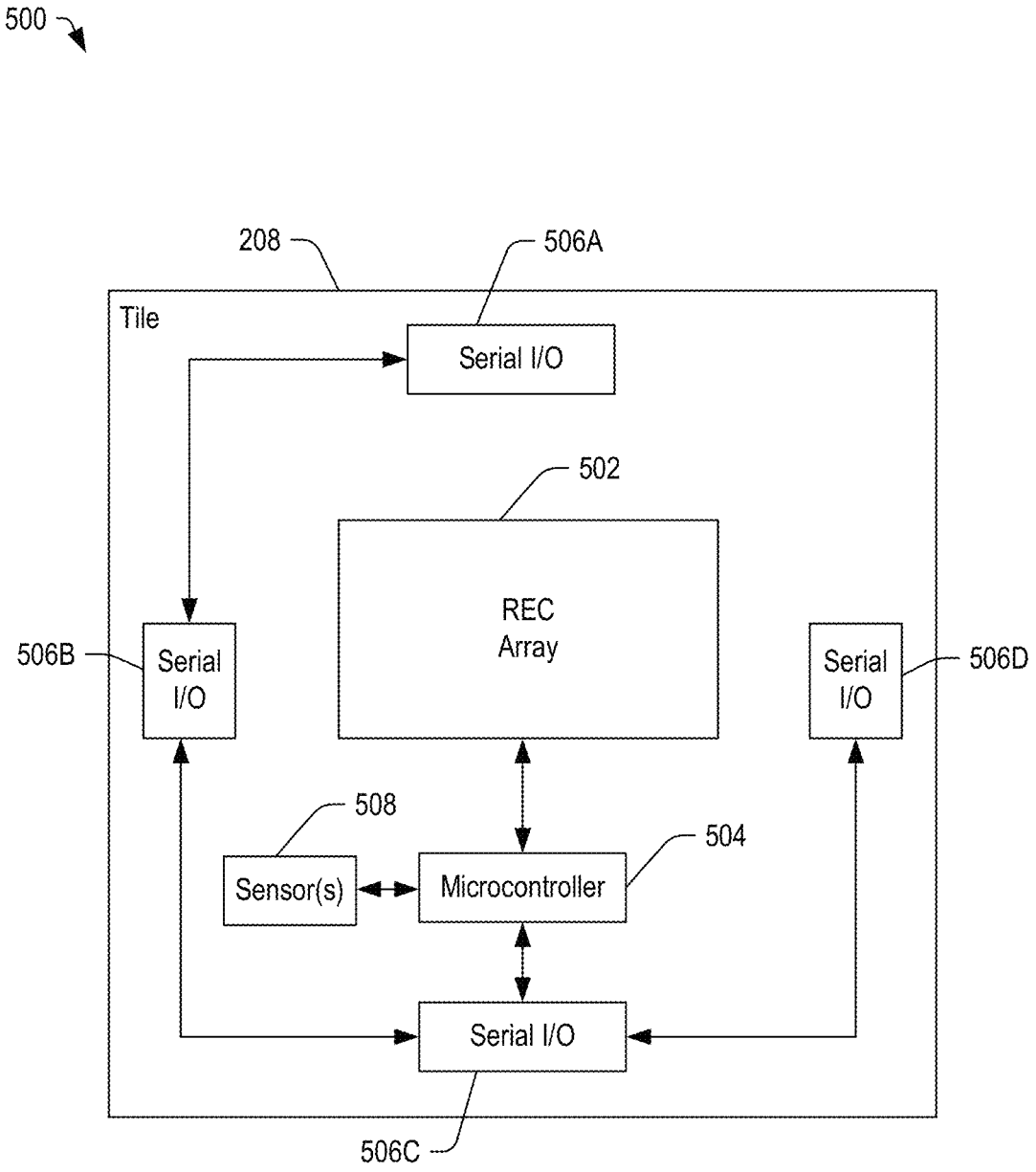
FIG. 5 depicts a block diagram of a reflectarray tile 208, in accordance with certain embodiments of the present disclosure.

FIG. 5 depicts a block diagram 500 of a reflectarray tile 208, in accordance with certain embodiments of the present disclosure. Each reflectarray tile 208 may include an REC array 502 formed from a plurality of cells 210. Further, each reflectarray tile 208 may include a microcontroller 504 coupled to each cell 210 of the REC array 502 and coupled to a plurality of serial Input/Output (I/O) ports 506. The serial I/O ports 506 may interconnect the tile 208 to the frame 102 and to other tiles 208 through the frame 102. Other embodiments are also possible.

In some embodiments, the REC array 502 may include a digitally controlled array of reflective element cells 210. Dual polarization antenna elements may utilize available tile area to enhance (and sometimes maximize) efficiency. In some embodiments, the serial I/O ports 506 may be arranged peripherally to provide serial communication links to adjacent tiles. In some embodiments, short range diode and detector pairs may be arranged on the edges. In some embodiments, the tile 208 may be environmentally sealed with no connectors, allowing for inductive signaling. Cabling or wiring may extend from the controller 110 to the edge of any tile 208 via the frame 102.

In some embodiments, the populated frame 102 or antenna 302 may include a plurality of tiles 208 that can provide multiband configurations within a single tile 208 using interlaced narrow band antenna elements as well as wideband elements with multiplexed reflections. Further, the antenna 302 may utilize tiles 208 of different frequencies. The frame 102 may be populated with a mixture of tiles 208 of various frequencies. Further, in some embodiments, dedicated areas of the array of tiles 208 may be allocated for each frequency band in view of the feed or additional feeds.

In some embodiments, the tile 208 may include one or more sensors 508 coupled to the microcontroller 504. In some embodiments, the one or more sensors 508 may include a suite of sensors that may provide actionable data to the microcontroller 504. The one or more sensors 508 can include an inertial measurement unit (IMU) chip, which may include gyroscopes, accelerometers, magnetometers, other motion sensors, other incline sensors, or any combination thereof. The IMU chip may allow the tile 208 to make high speed phase corrections locally for stabilization.

Additionally, the one or more sensors 508 can include one or more temperature sensors for local calibration and corrections. The one or more sensors 508 can also include humidity/moisture sensors that can be used to detect potential failure modes. Additionally, the one or more sensors 508 may include pressure/altitude sensors. The tile 208 may share sensor data with neighboring tiles for high confidence in data, drift correction, self-checking, maintenance, or any combination thereof.

In some embodiments, the tiles 208 are provided data serially with a high level of communications efficiency. Commands may be interleaved by giving an extrapolated position based on current position and a velocity vector from the main controller 110. The controller 110 may potentially send a small number of phase values per tile (such as nine). The microcontroller 504 in the tile 208 may interpolate values for each cell based on the provided data. Information about the required phase gradients may be known locally to the controller. In some embodiments, the refresh rate of the tile 208 may be a function of the beam contribution. High contributors may have the shortest update period, because they impact the pattern more significantly. Outlying signal elements that may dominate side lobe performance may be updated on longer schedules.

In some embodiments, beam correction and pointing error calibration can be performed in multiple ways. For example, amplitude comparison monopulse can be performed with a four-port feed 104 using sum and difference beams. Further, conical scanning and/or nulling techniques can use the beam steering capability of the tiles 208. Further, the beam correction and pointing error calibration can be performed periodically, as required, during initial installation, based on long-term drift, and so on.

Figure 6A:
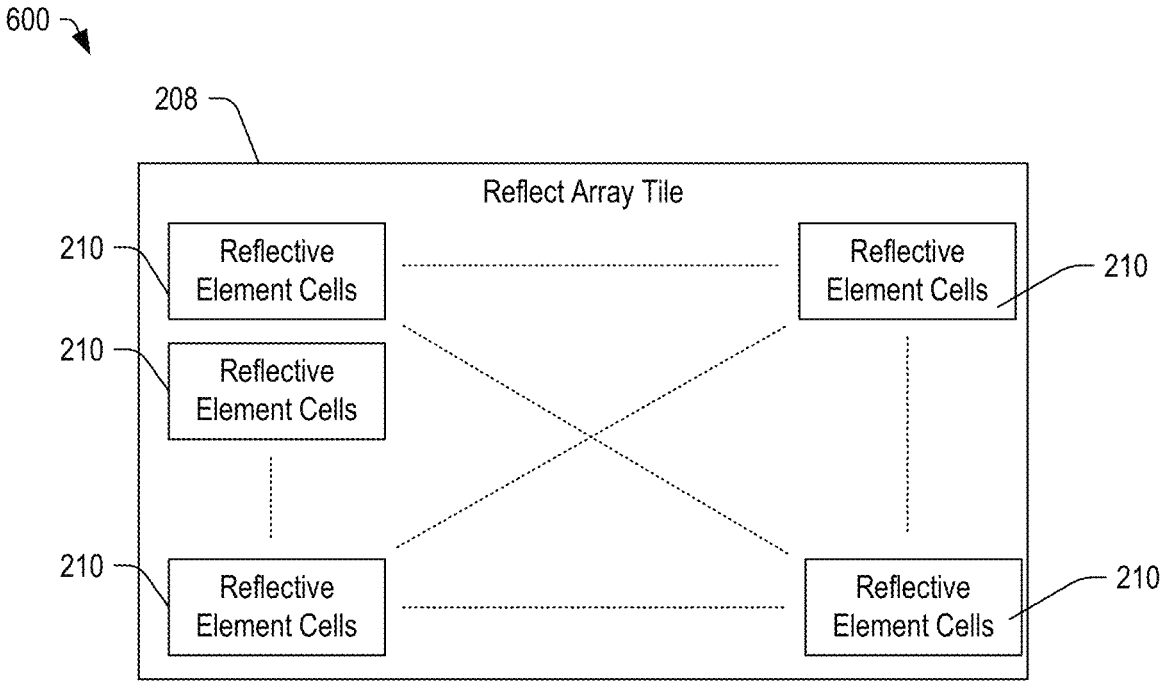
FIG. 6A depicts a reflectarray tile formed from a plurality of reflective element cells, in accordance with certain embodiments of the present disclosure.

FIG. 6A depicts a block diagram 600 of a reflectarray tile 208 formed from a plurality of RECs 210, in accordance with certain embodiments of the present disclosure. In some embodiments, the plurality of RECs 210 may be arranged in an M×N matrix. Any number of RECs 210 may be included within a reflectarray tile 208, and any number of reflectarray tiles 208 may be included within a reflectarray antenna that is formed by coupling the reflectarray tiles 208 to the frame elements 108 of the frame 102.

Further, the reflectarray tile 208 may be single band or multi-band. In a multi-band tile, the RECs 210 may be stacked vertically (for example, forming a three-dimensional matrix) and at different lattice spacing to meet the spatial sampling requirements of the selected band.

Figure 6B:
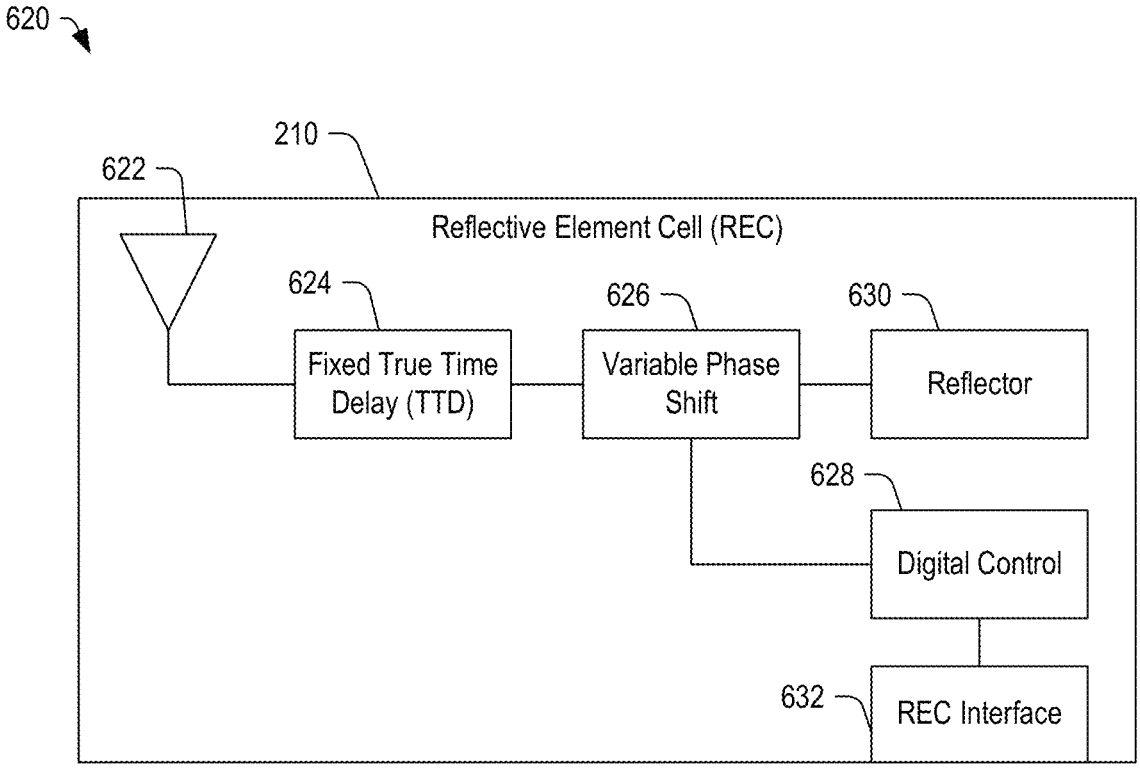
FIG. 6B illustrates a reflective element cell, in accordance with certain embodiments of the present disclosure.

FIG. 6B illustrates a block diagram 620 of a reflective element cell 210, in accordance with certain embodiments of the present disclosure. The reflective element cell 210 may include an antenna element 622 coupled to a reflector 630 via a fixed true time delay (TTD) 624 and a variable phase shift 626. The variable phase shift 626 may be coupled to a digital control 628, which may be configured to selectively adjust the phase of the variable phase shift 626. The digital control 628 may be coupled to an REC interface 632, which may be configured to couple to the reflector interface 434 of FIG. 4C.

In some embodiments, the fixed TTD 624 may be at least partially related to the physical position within the frame. The variable phase shift 626 may be controlled by the control system 110 in FIGS. 1-3 through the frame element 108 to point the REC 210 at the desired satellite. Further, in some embodiments, the system in which the REC 210 is included may self-configure, because each tile 208 may be aware of its location within the array, in part, based on its neighbors, its assigned frame element identifier, or based on an assigned identifier from a host controller. Other embodiments are also possible.

In some embodiments, RF performance may be determined by a number of component parameters, such as the antenna element unit cell area efficiency and match, delay line losses, and phase shift range, resolution, and reflection quality. In some embodiments, structural mode scattering may not contribute to the desired beam, and antenna mode scattering may be impacted by the desired phase shift. Delay line losses may have a two-way impact, as the delay may sit between the antenna element and the reflection. Applications that require a controlled time delay would be impacted by switch losses; however, the frame 102 and the modular structure of the tiles 208 provides a fixed time delay that lends itself to fixed coarse geometry correction in basic implementations. Variable delays may be provided for wide instantaneous bandwidth and large apertures in high performance applications. Traditional transmit/receive functionality may not be required at each element. Gain stages, circulators, switches, and other signal grooming elements may be omitted from the signal path. Further, each tile 208 and each cell 210 can be constructed with a low component count, to consume low power, and at a low cost.

In some embodiments, the reflectarray fabrication can be low cost and of a selected precision. Suitable fabrication technologies can include three-dimensional (3D) printing, lithography, selective laser sintering (SLS), and direct metal laser sintering (DMLS). Further, manufacturing process technologies can include casting and molding processes, including investment casting, fusible core casting, and soft tooled plated plastics. Other embodiments are also possible.

While traditional phased array control systems can be computationally intensive and often consume significant DC power resources, the reflectarray elements do not require continuous bias and control. The signal path may be primarily passive. Further, reflection control voltage can be locally stored and refreshed periodically (sample and hold). Tiles 208 can use row and column addressing similar to memory and display technology controllers.

Figure 7:
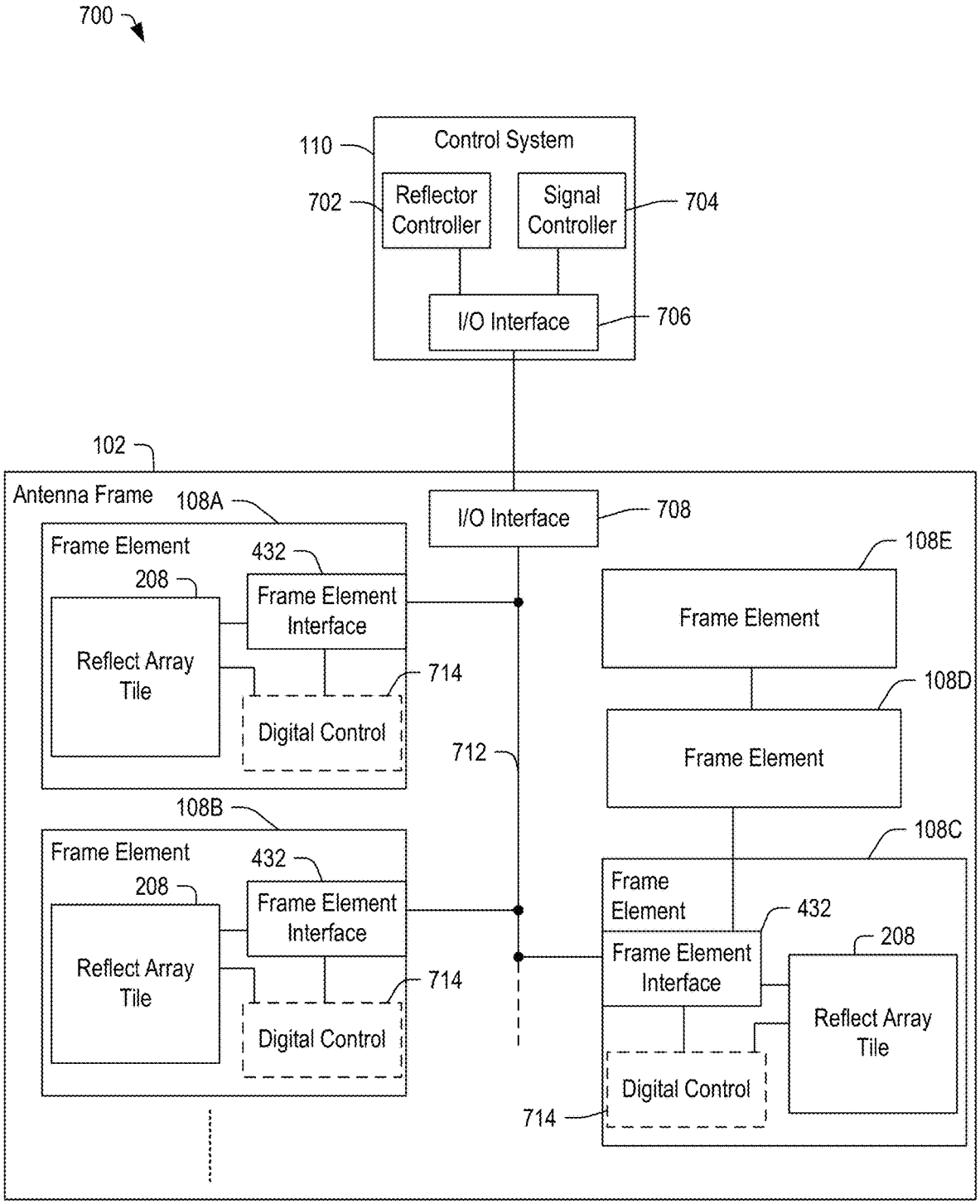
FIG. 7 depicts a block diagram of a conformal antenna system, in accordance with certain embodiments of the present disclosure.

FIG. 7 depicts a block diagram of a conformal antenna system 700, in accordance with certain embodiments of the present disclosure. The conformal antenna system 700 may include an antenna frame 102 formed from a plurality of frame elements 108A, 108B, 108C, 108D, and 108E and coupled to a control system 110.

The control system 110 may be within or coupled to a vehicle (such as an aircraft or automobile) or may be integrated within the frame 102, depending on the implementation. The control system 110 may include a microcontroller, a field programmable gate array or other data processing circuitry that may be configured to control transmission and reception of signals via the reflectarray antenna. The control system 110 may include a reflector controller 702, a single controller 704, and an input/output (I/O) interface 706. The I/O interface 706 may be configured to communicate data and control signals to and receive data from reflectarray tiles 208 coupled to the frame 102.

The frame 102 may include an I/O interface 708 coupled to the I/O interface 706 of the control system 110. The I/O interface 708 may be coupled to a bus 712 to which each of the frame elements 108A, 108B, and 108C are coupled. Further, in some instances, one or more of the frame elements 108 may be coupled to the I/O interface 708 through another frame element 108. For example, frame elements 108D and 108E are coupled to the bus 712 through the frame element 108C.

Each frame element 108 may include a frame element interface 432, which may be configured to couple to the bus 712, to a frame element interface 432 of an adjacent frame element 108, or both. The frame element interface 432 may be coupled to the reflectarray tile 208 through a reflector interface 434 (in FIG. 4). Further, the frame element interface 432 and the reflectarray tile 208 may be coupled to or may include a digital control 714 (such as the digital control 628 in FIG. 6), which may control phase changes and other operational variables of each of the plurality of reflectarray tiles 208 directly or in response to control signals from the control system 110. Other embodiments are also possible.

In some embodiments, the system 700 provides a cascaded control architecture. Each tile 208 and its sensors provide a first inner loop, which may be at a highest speed relative to other control loops. The control system 110 and its data may provide a second control loop, which may be at a slower speed relative to the first inner loop. The system 700 further includes a slower outer loop for calibration and long-term drift correction.

In some embodiments, each tile 208 may include a light pipe or diffuse edge lighting configured to indicate information when the system 700 is in a maintenance mode. The light may be provided using a red/green/blue (RGB) light-emitting diode (LED). The light may provide a good/bad tile indication, a programming state, and so on. In some embodiments, particular colors or a blinking pattern may be used to indicate a status, such as an error. Other embodiments are also possible.

Figure 8A:
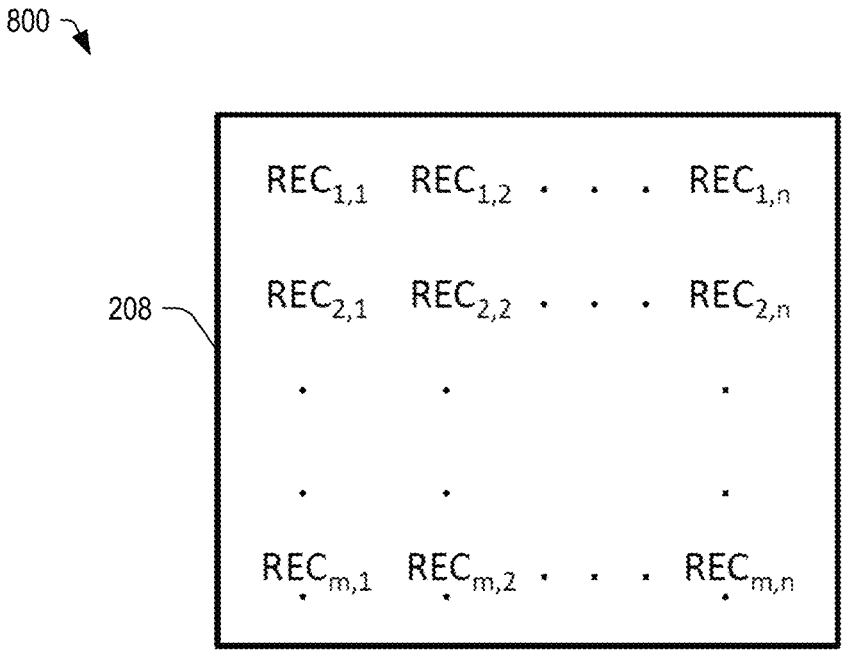
FIG. 8A depicts a single band reflectarray tile, in accordance with certain embodiments of the present disclosure.

FIG. 8A depicts a block diagram 800 of a single band reflectarray tile 208, in accordance with certain embodiments of the present disclosure. The single-band reflectarray tile 208 includes a plurality of RECs 210 arranged in a matrix, having M rows and N columns (e.g., an M×N matrix).

Figure 8B:
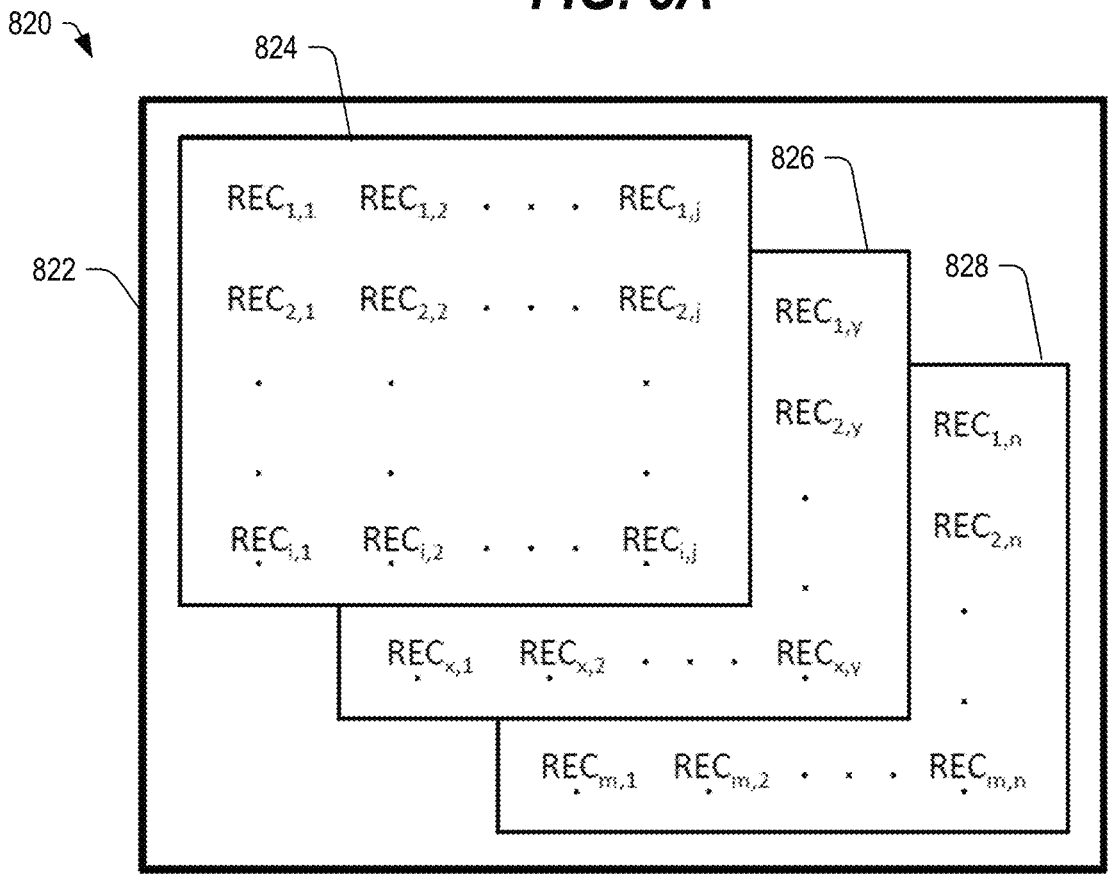
FIG. 8B depicts a multi-band reflectarray tile, in accordance with certain embodiments of the present disclosure.

FIG. 8B depicts a block diagram 820 of a multi-band reflectarray tile 822, in accordance with certain embodiments of the present disclosure. The multi-band reflectarray tile 822 may be an example of a reflectarray tile 208. The multi-band reflectarray tile includes a first layer 824, a second layer 826, and a third layer 828. Each layer 824, 826, and 828 may include a matrix of RECs 210. The layers 824, 826, and 828 may be stacked vertically, and the RECs 210 may be stacked vertically and spaced apart to provide a multi-band functionality. In a particular example, the RECs 210 would include three layers of reflective element cells separated by a ground plane. Further, the RECs 210 would include three layers comprised of the remaining parts. While only three layers are shown, the multi-band reflectarray tile 822 may include any number of layers to provide a desired multi-band functionality. Other embodiments are also possible.

In some embodiments, a frame 102 may be populated by multiple reflectarray tiles 208, multiple multi-band reflectarray tiles 822, or any combination thereof. In some embodiments, each reflectarray tile 208 or 822 may be independently controlled. In certain examples, each matrix within a multi-band reflectarray tile 822 may be independently controlled. Other embodiments are also possible.

Figure 9:
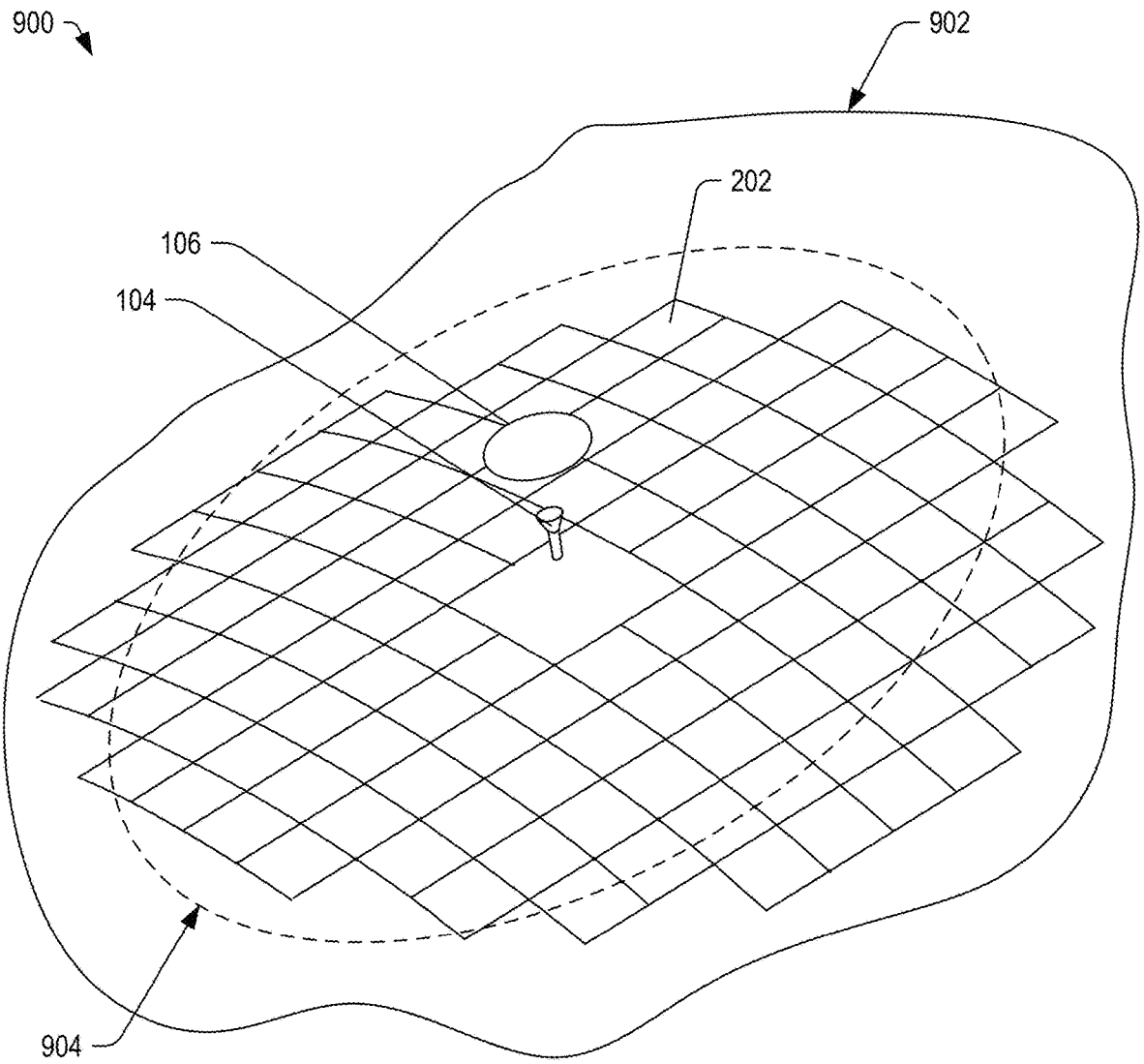
FIG. 9 depicts a conformal reflectarray mounted on a surface of an aircraft under a radome, in accordance with certain embodiments of the present disclosure.

FIG. 9 depicts a portion of a system 900 including conformal reflectarray 202 mounted on a surface 902 of an aircraft under a radome 904, in accordance with certain embodiments of the present disclosure. The feed may illuminate the sub-reflector 106, which in turn illuminates the reflectarray 202. Underlying the conformal reflectarray 202, the frame 102 can secure the reflectarray tiles 208 to the surface 802.

Figure 10:
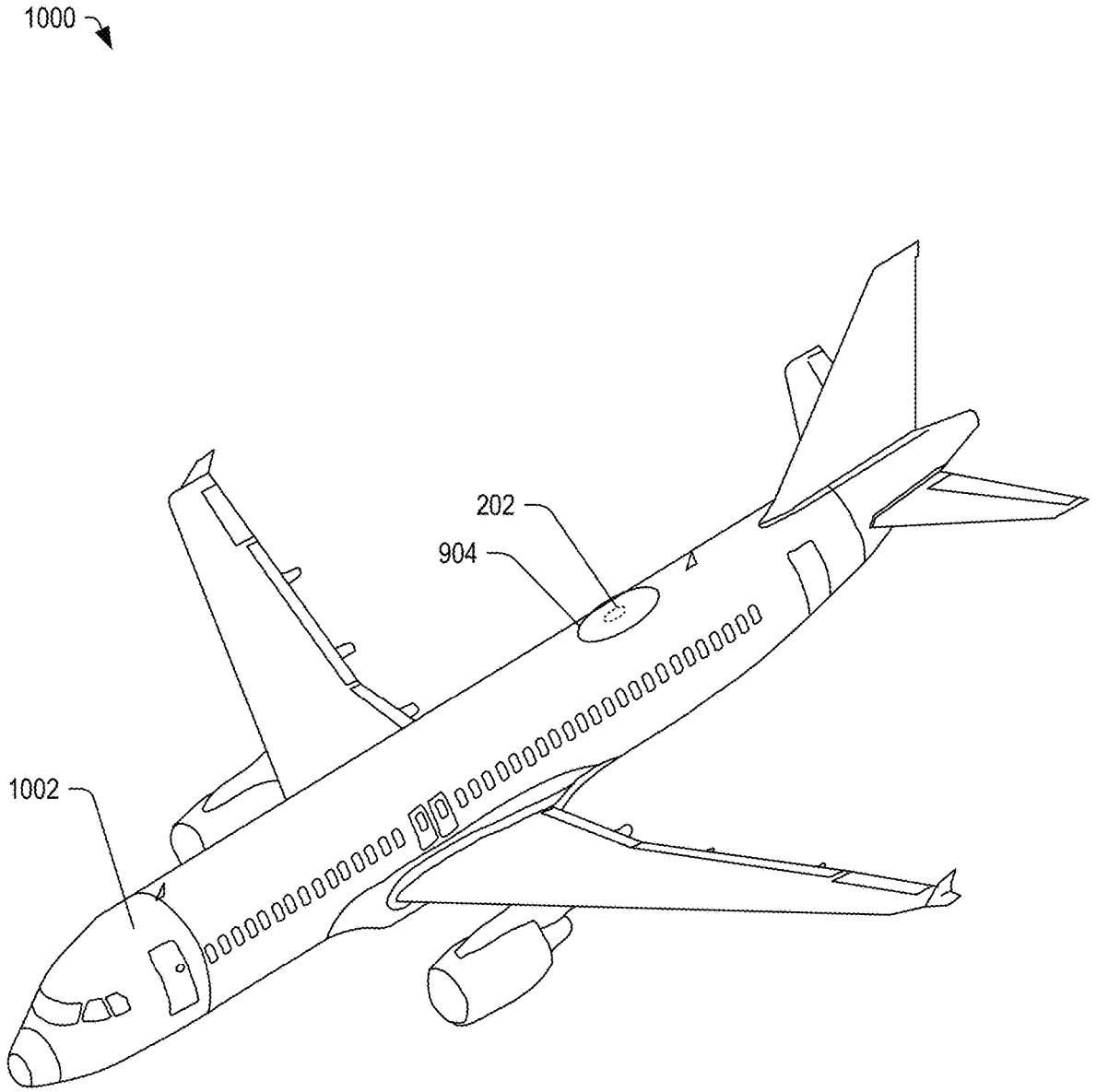
FIG. 10 depicts a perspective view of a system including an aircraft with a conformal reflectarray, in accordance with certain embodiments of the present disclosure.

FIG. 10 depicts a perspective view of a system 1000 including an aircraft 1002 with a conformal reflectarray 202, in accordance with certain embodiments of the present disclosure. The conformal reflectarray 202 may be coupled to the surface 1002 by a frame 102 formed from a plurality of frame elements 108 and may be positioned beneath a radome 904. In this example (shown in FIGS. 8 and 9), the feed 104 may directly illuminate the surface of the reflectarray 202, such as in a parabolic reflector antenna. Alternatively, the feed 104 may illuminate the surface of the reflectarray 202 by means of the sub-reflector 106, such as in a Cassegrain configuration, a Gregorian configuration, or a displaced axis/ring focus variant of either configuration. Other embodiments are also possible.

Figure 11A:
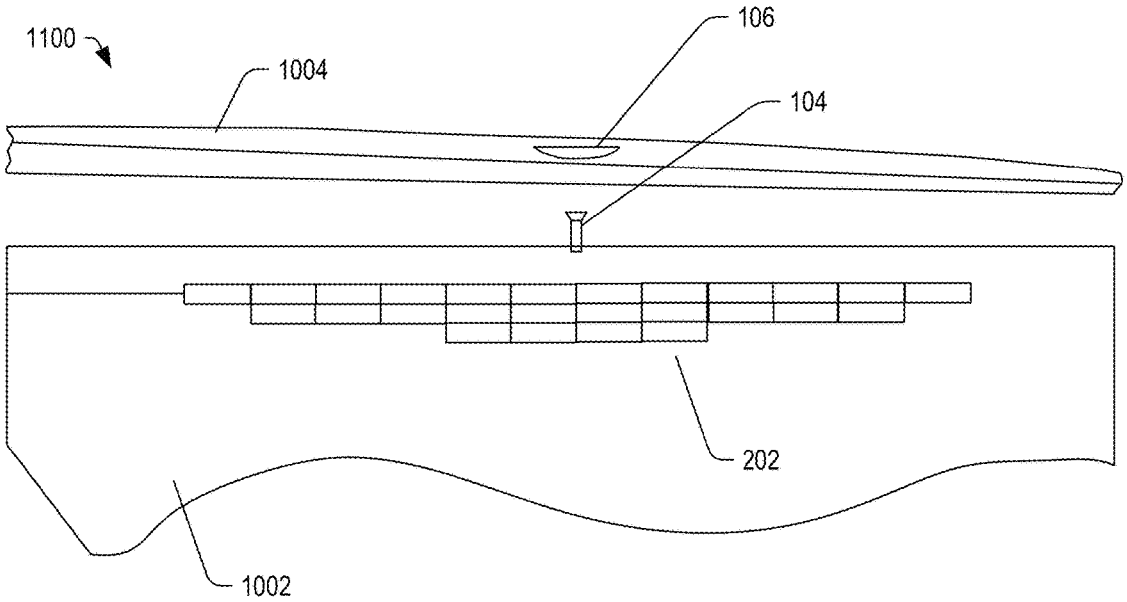
FIG. 11A depicts a side view of a system including an exemplary radome with a conformal reflectarray, in accordance with certain embodiments of the present disclosure.

FIG. 11A depicts a side view of a system 1100 including a radome 1104 with a conformal reflectarray 202, in accordance with certain embodiments of the present disclosure. The horn 104 (or feed) and the sub-reflector 106 may illuminate the reflectarray 202.

Figure 11B:
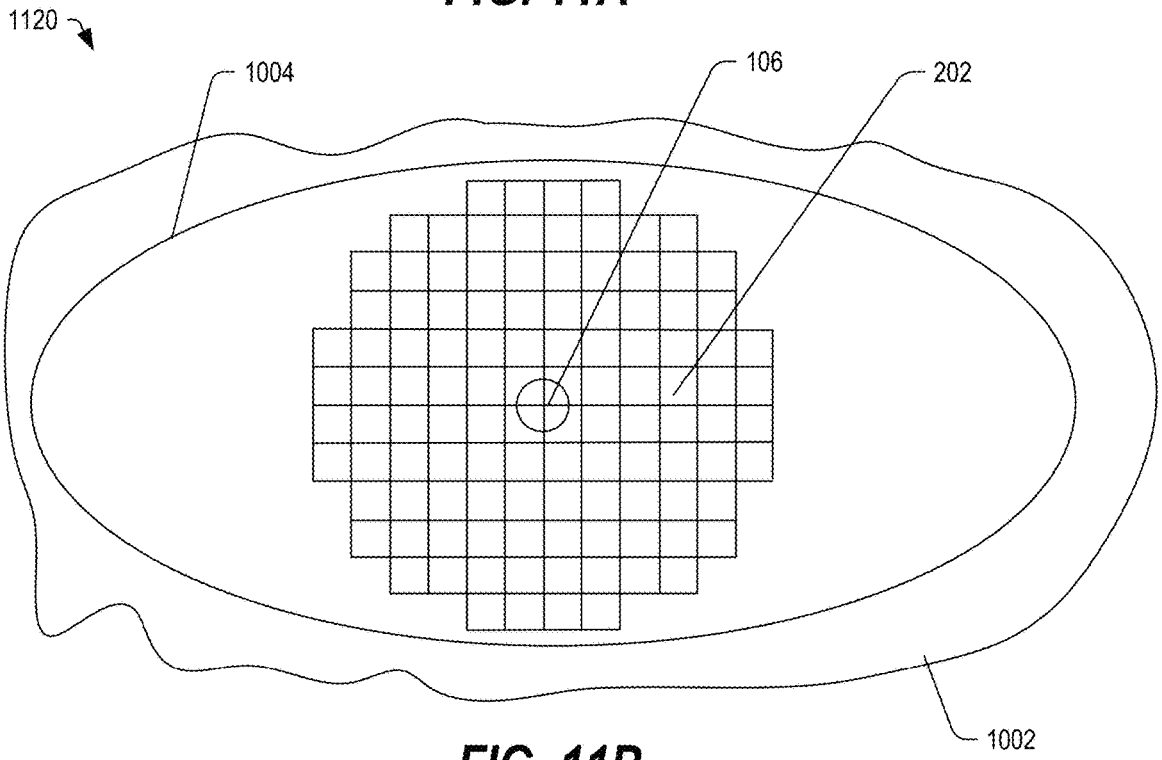
FIG. 11B depicts a top view of the system of FIG. 11A, in accordance with certain embodiments of the present disclosure.

FIG. 11B depicts a top view 1120 of the system 1100 of FIG. 11A, in accordance with certain embodiments of the present disclosure. The top view 1120 depicts the radome 1104 positioned and centered over the sub-reflector 106 and the reflectarray 202. Other embodiments are also possible.

In the embodiments of FIGS. 11A and 11B, the tiles 208, the feed 104, and the sub-reflector 106 may be protected by an overarching radome 1004. However, in some embodiments, the tiles 208, the frame 102, and the various electrical interconnections may be sealed from the ambient environment, and the radome may be configured to cover only the feed 104 and the subreflector 106 to form a feed assembly, as discussed below with respect to FIGS. 12A and 12B.

Figure 12A:
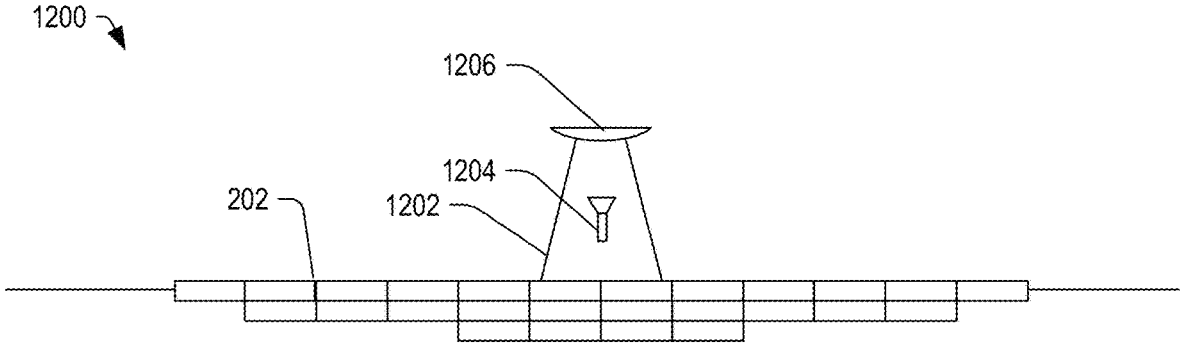
FIG. 12A depicts a side view of a system including a feed, subreflector, and a radome covering with a conformal reflectarray, in accordance with certain embodiments of the present disclosure.

FIG. 12A depicts a side view of a system 1200 including a feed 1204, a sub-reflector 1206, and a radome covering 1202 with a conformal reflectarray 202, in accordance with certain embodiments of the present disclosure. In this example, a radome covering 1202 may encompass the feed 104 and the sub-reflector 1206. The reflectarray 202 and the associated frame 102 can be sealed such that an overarching radome may be omitted.

The radome covering 1202 may cover a horn 1204 and a sub-reflector 1206, which may cooperate to form a feed assembly configured to illuminate the reflectarray 202. In general, the radome 1202 may be a structural, weatherproof enclosure that protects the feed 1204 and the sub-reflector 1206. In this embodiment, the reflectarray 202 is sealed and does not require protection from the over-arching radome (such as the radome 1104 of FIG. 11A).

Typically, the radome may be constructed of material that allows for transmission and reception of the electromagnetic signal by the antenna. In some embodiments, the material may be effectively transparent to radio waves. The radome may be configured to protect the antenna from the ambient environment and to conceal antenna electronic equipment from view.

It should be understood that the blade radome 1202 represents one possible implementation, but other implementations are also possible. In some embodiments, the radome 1202 may be implemented in other shapes, such as spherical, geodesic, planar, and so on, depending on the particular application. Further, the radome 1202 may be constructed using a variety of materials, including, for example, fiberglass, polytetrafluoroethylene-coated (PTFE-coated) fabric, other materials, or any combination thereof.

Figure 12B:
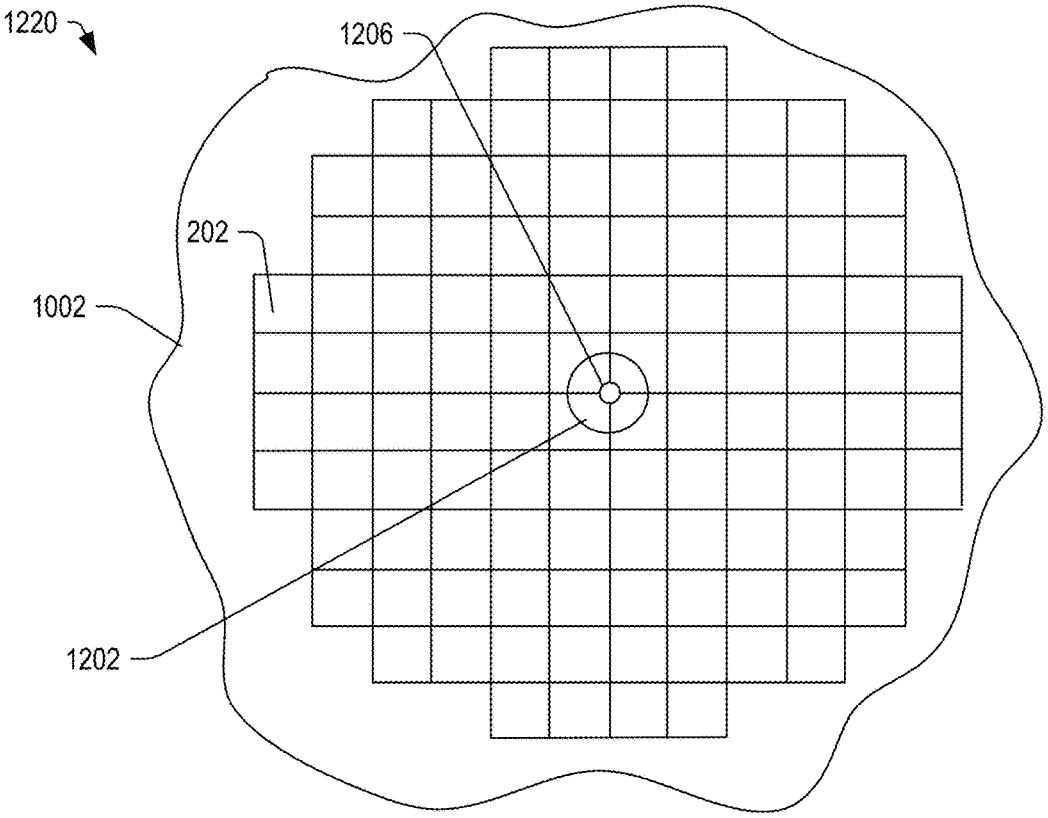
FIG. 12B depicts a top view of the system of FIG. 12A, in accordance with certain embodiments of the present disclosure.

FIG. 12B depicts a top view 1220 of the system 1200 of FIG. 12A, in accordance with certain embodiments of the present disclosure. In the top view 1220, the blade radome 1202 and the sub-reflector 106 are depicted at a center of the reflectarray 202. Other embodiments are also possible.

Figure 13A:
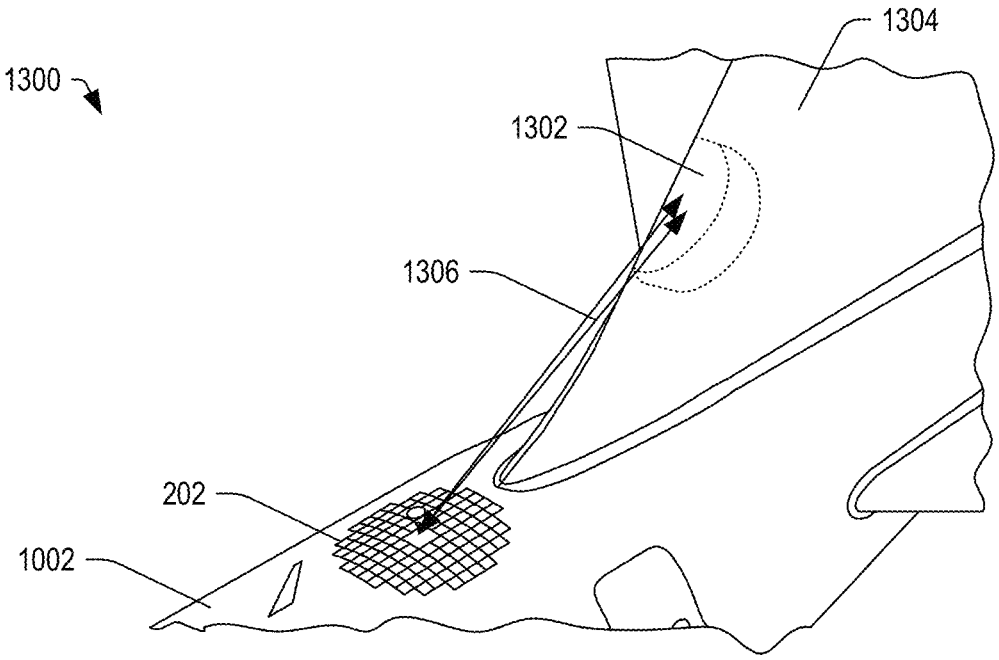
FIG. 13A depicts a perspective view of an aircraft including a conformal reflectarray configured to receive electromagnetic signals from a source in a tail of the aircraft, in accordance with certain embodiments of the present disclosure.

FIG. 13A depicts a perspective view of a portion 1300 of an aircraft including a conformal reflectarray 202 configured to direct electromagnetic signals 1306 toward and receive signals from a source (such as one or more feeds 104) in a portion 1302 of a tail 1304 of the aircraft, in accordance with certain embodiments of the present disclosure. The reflectarray 202 may conform to the curved surface 1002 of the aircraft and the feed 104 may be embedded within the tail 1304. The tail 1304 may be formed with a portion of the surface being transparent with respect to the electromagnetic signals 1306.

Figure 13B:
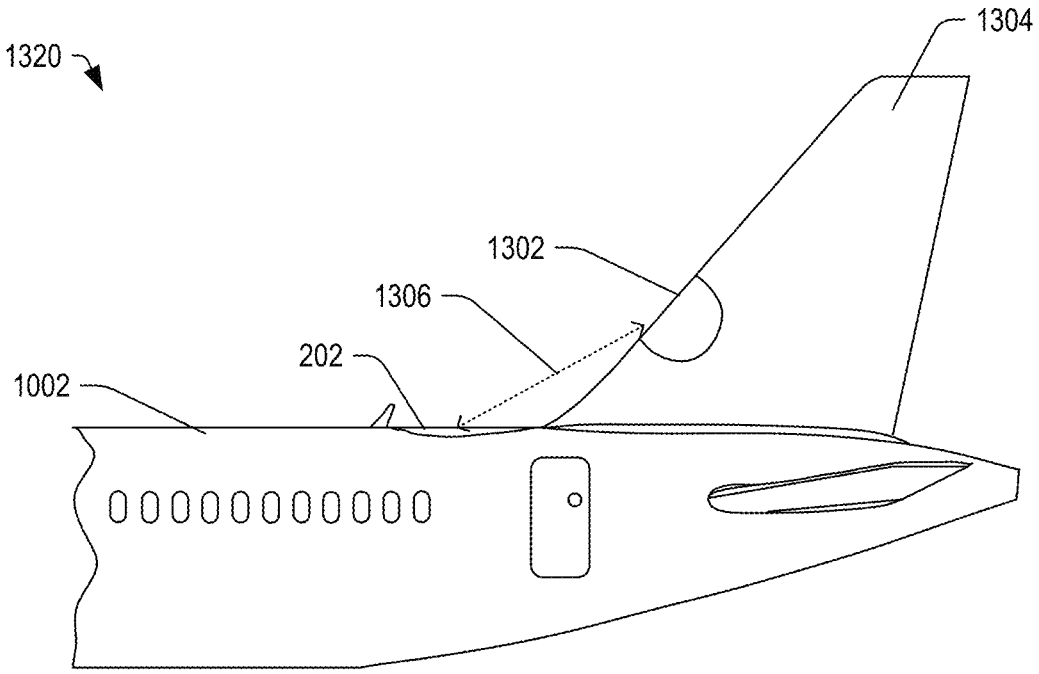
FIG. 13B depicts a side view of the aircraft of FIG. 13A, in accordance with certain embodiments of the present disclosure.

FIG. 13B depicts a side view 1320 of the aircraft of FIG. 13A, in accordance with certain embodiments of the present disclosure. In the side view, the antenna array 202 is shown to conform to the surface 1002 of the aircraft. Further, the tail 1304 may include a feed portion 1302 including one or more feeds 104 configured to illuminate the reflectarray 202. Other embodiments are also possible.

Figure 14A:
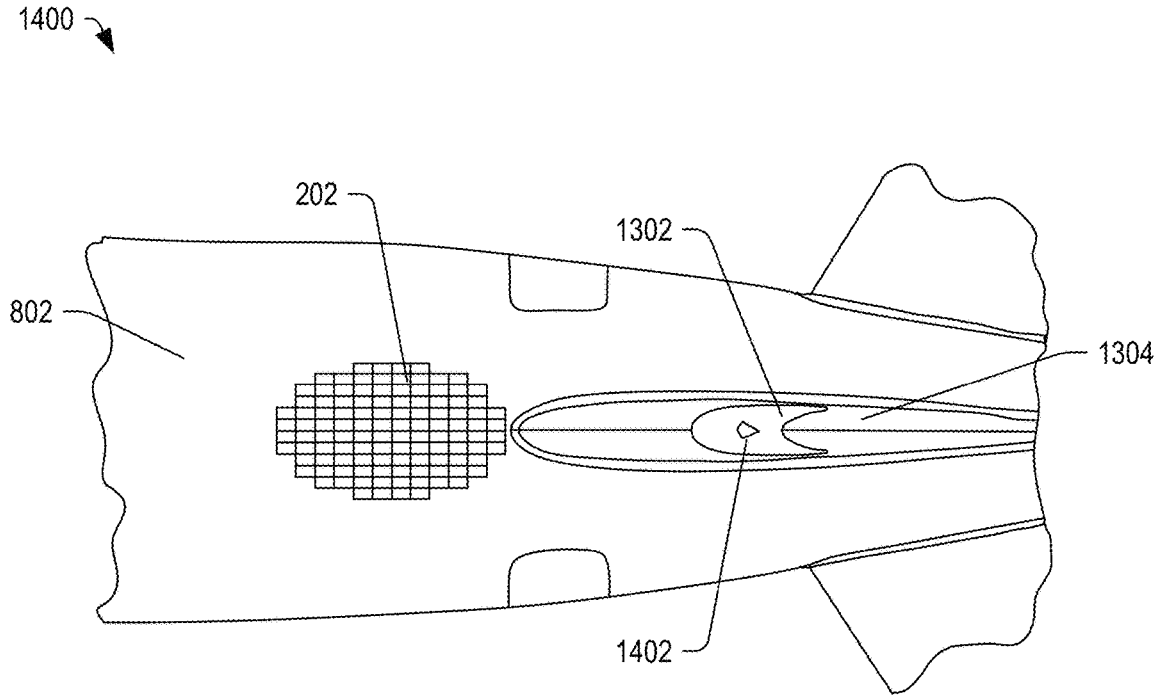
FIGS. 14A-14B depict a top view of an aircraft system including a conformal reflectarray configured to receive signals from a source in a tail of the aircraft, in accordance with certain embodiments of the present disclosure.
Figure 14B:
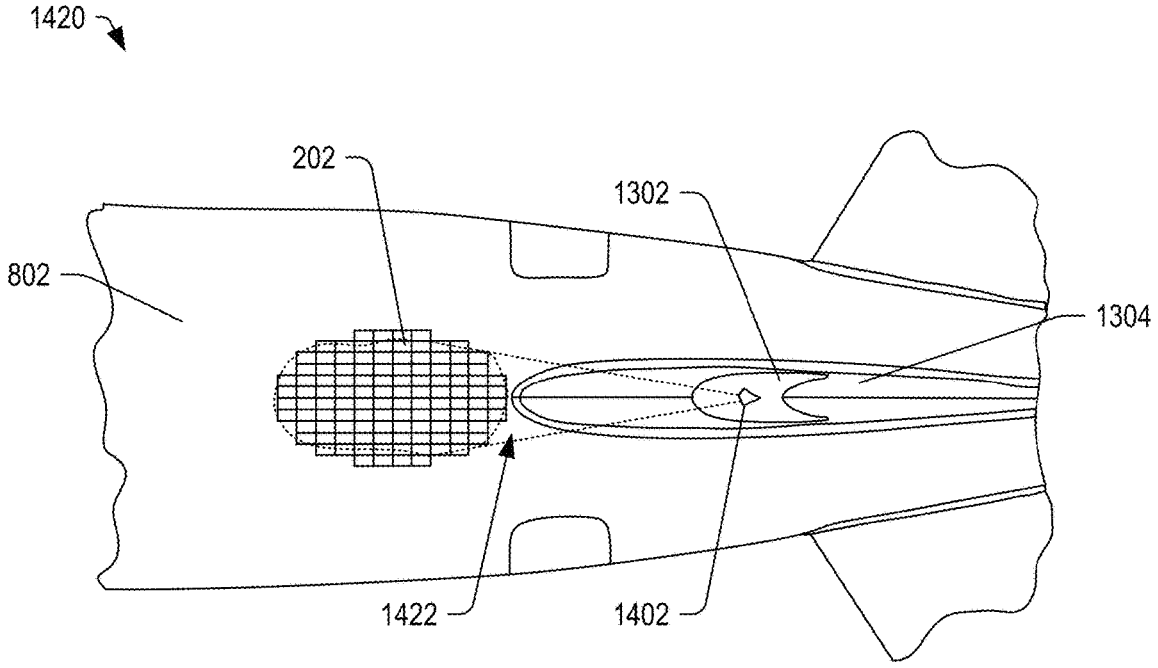

FIGS. 14A-14B depict a top view of an aircraft system including a conformal reflectarray configured to receive signals from a source in a tail of the aircraft, in accordance with certain embodiments of the present disclosure. In FIG. 14, one or more feeds 1402 may be positioned within a feed portion 1402 of a tail 1404 of the aircraft. The reflectarray 202 may be coupled to a surface 1002 of the aircraft adjacent to the tail 1404. The one or more feeds may selectively illuminate the reflectarray 202, as shown in FIG. 14B. In FIG. 14B, the one or more feeds 1402 may illuminate the reflectarray 202, as generally indicated at 1422. Other embodiments are also possible.

Figure 15:
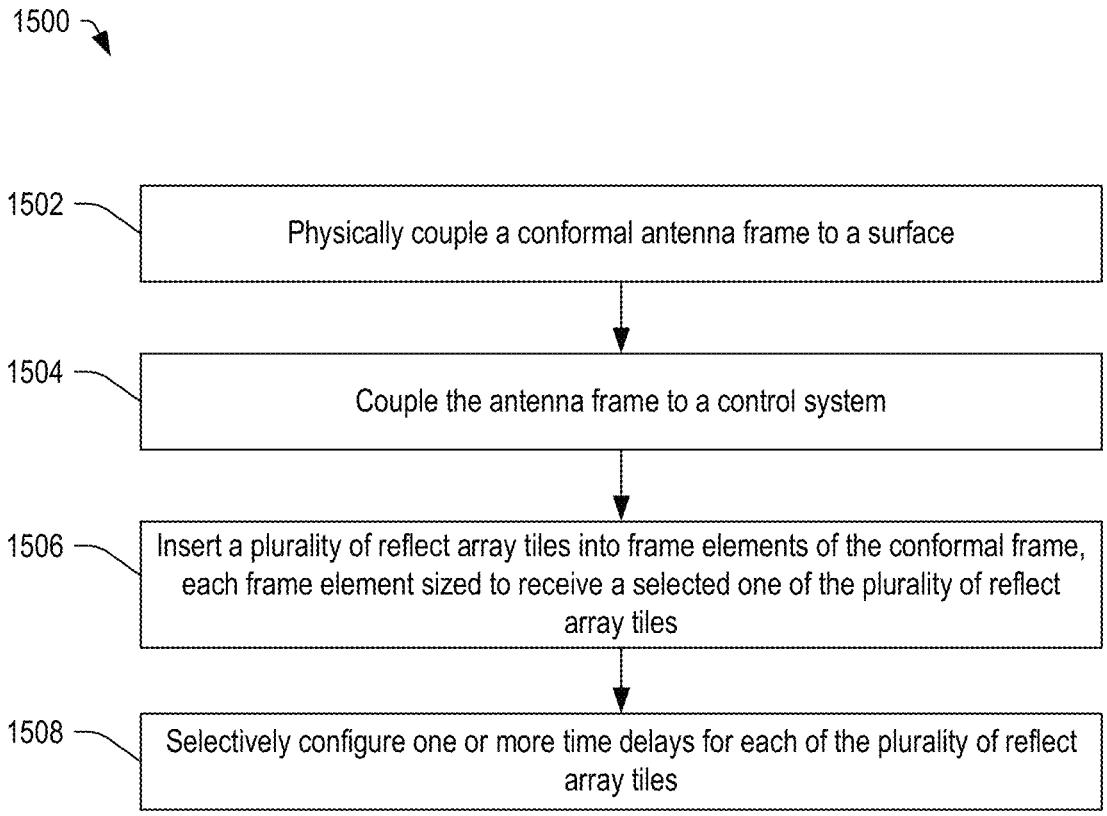
FIG. 15 illustrates a flow diagram of a method of installing a reflectarray antenna, in accordance with certain embodiments of the present disclosure.

FIG. 15 illustrates a flow diagram of a method 1500 of installing a reflectarray antenna, in accordance with certain embodiments of the present disclosure. At 1502, the method 1500 may include physically coupling a conformal antenna frame to a surface. In some embodiments, the conformal antenna frame may be formed from a plurality of frame elements, which may be coupled to one another and then to the surface. In some embodiments, a first frame element may be coupled to the surface, and a second frame element may be coupled to the first frame element. Other embodiments are also possible.

At 1504, the method 1500 can include coupling the antenna frame to a control system. In some embodiments, a frame element of a plurality of frame elements may be coupled to the control system. In some embodiments, the control system may be coupled to a common bus of the conformal antenna frame. In certain embodiments, the coupling may include coupling a connector associated with the frame to a connector associated with the control system. The connector may include an electrical interface, an optical interface, or any combination thereof. The connector associated with the frame may include an I/O interface configured to couple to a shared bus or to a daisy-chain type of interconnection established through the interconnections of the frame elements.

At 1506, the method 1500 can include inserting a plurality of reflectarray tiles into the plurality of frame elements, where each frame element is sized to receive a selected one of the plurality of reflectarray tiles. In some embodiments, one or more of the reflectarray tiles may be single-band tiles. In some embodiments, one or more of the reflectarray tiles may be multi-band tiles. In some embodiments, multi-band and single-band reflectarray tiles may be used.

At 1508, the method 1500 can include selectively configuring one or more phase delays associated with each of the plurality of reflectarray tiles. In an example, each reflectarray tile may have a fixed time delay associated with the physical structure of the frame, the interconnections, and the reflectarray tile itself. Further, each reflectarray tile may have a variable phase that can be configured selectively to point the antenna at a desired satellite and to tune signal reception. Other embodiments are also possible.

In conjunction with the apparatus, systems and methods described above with respect to FIGS. 1-15, a frame is described that can include a plurality of frame elements, which may be interconnected mechanically and electrically. Further, each frame element may be configured to receive and secure a reflectarray tile, which may include a single layer of reflective element cells (RECs) arranged in an M×N matrix or which may include multiple layers of RECs, each layer arranged in an M×N matrix and having different lattice spacings to meet spatial sampling requirements. Other embodiments are also possible.

In the above discussion, a control system is mentioned that may be separate from the frame and that may be electrically coupled to the frame. In some embodiments, the control system may be integrated within the frame or within a mounting structure associated with the frame to facilitate installation and operation of the reflectarray. Further, since the frame is formed from multiple frame elements, the size and geometric configuration of the frame may be adjusted in a modular fashion by adding or removing frame elements. Additionally, to adjust the receptivity or function of the reflectarray, tiles may be changed or removed (for example to switch between single-band and multi-band operation). Other embodiments are also possible.

Although the present invention has been described with reference to preferred embodiments, workers skilled in the art will recognize that changes may be made in form and detail without departing from the scope of the disclosure.

What is claimed is:

1. An apparatus comprising:

a plurality of reflectarray tiles; and a frame including a plurality of frame elements, each frame element including a frame coupling interface configured to electrically and mechanically couple the frame element to one or more adjacent frame elements, the plurality of frame elements configured to couple to an exterior surface of an aircraft or a terrestrial vehicle and to conform to a shape of the exterior surface, each frame element including a recessed portion inset from a sidewall of the frame element and configured to receive one of the plurality of reflectarray tiles, the frame provides mechanical registration and alignment to a known physical geometry, each frame element of the plurality of frame elements includes wiring to communicatively couple each reflectarray tile to a control system to receive power via a power bus and to receive signals via one or more electrical interconnects to control a phase reflection of the reflectarray tile; and wherein each of the plurality of frame elements is modular such that one or more selected frame elements may be added to or removed from the frame to correspond to the plurality of reflectarray tiles.

2. The apparatus of claim 1, wherein each reflectarray tile includes a plurality of reflective element cells arranged in a matrix to receive signals within a selected frequency band.

3. The apparatus of claim 1, wherein each reflectarray tile includes a plurality of layers, each layer including a plurality of reflective element cells arranged in a matrix, the reflectarray tile configured to receive signals within multiple frequency bands.

4. The apparatus of claim 1, wherein:

the frame is configured to couple to an aircraft; and cells of at least one of the tiles are have a lattice spacing that is different from lattice spacing of cells of another tile.

5. The apparatus of claim 1, wherein the frame is configured to receive a distribution of variants of the tiles consistent with at least one of a selected aperture and a selected location.

6. The apparatus of claim 1, wherein each of the plurality of reflectarray tiles has a fixed time delay and are populated within the plurality of frame elements.

7. The apparatus of claim 6, wherein the fixed time delay of each of the plurality of frame elements is corrected with fixed coarse geometry correction.

8. The apparatus of claim 1, wherein each of the plurality of reflectarray tiles has a reflection phase.

9. The apparatus of claim 1, further comprising a feed configured to illuminate a surface of each of the plurality of reflectarray tiles.

10. An apparatus comprising:

a frame including a plurality of frame elements, each frame element including a frame coupling interface configured to electrically and mechanically couple the frame element to one or more adjacent frame elements to form the frame, the plurality of frame elements conforming to a shape of an exterior surface of an aircraft or a terrestrial vehicle, each of the plurality of frame elements including a recessed portion, each frame element of the plurality of frame elements including electrical interconnects to provide power and signals from a control system to an associated reflectarray tile; and a plurality of reflectarray tiles, each reflectarray tile sized to couple to one of the plurality of frame elements and to engage the recessed portion and the electrical interconnects, the plurality of reflectarray tiles configured to couple to the plurality of frame elements to form a conformal reflectarray, each reflectarray tile of the plurality of reflectarray tiles responsive to the signals received from the control system via the electrical interconnects of the frame element to adjust a phase reflection of the reflectarray tile; and wherein each frame element of the plurality of frame elements is modular such that selected frame elements may be added or removed from the frame to accommodate a selected number of reflectarray tiles.

11. The apparatus of claim 10, wherein the frame is configured to couple to the exterior surface of the aircraft or the terrestrial vehicle.

12. The apparatus of claim 10, further comprising an illumination source configured to illuminate at least a portion of the conformal reflectarray.

13. The apparatus of claim 10, wherein each reflectarray tile includes a plurality of reflective element cells arranged in a matrix to receive signals within a selected frequency band.

14. The apparatus of claim 10, wherein each reflectarray tile includes a plurality of layers, each layer including a plurality of reflective element cells arranged in a matrix, the reflectarray tile configured to receive signals within multiple frequency bands.

15. The apparatus of claim 10, wherein the surface includes a surface of an aircraft.

16. The apparatus of claim 10, wherein the surface includes a surface of a terrestrial vehicle.

17. An apparatus comprising:

a conformal antenna array including:

a plurality of reflectarray tiles; and a frame including a plurality of frame elements, each frame element including a frame coupling interface configured to electrically and mechanically couple the frame element to one or more adjacent frame elements to form the frame, the plurality of frame elements conforming to a shape of an exterior surface of a vehicle, each frame element including a recessed portion configured to receive one of the plurality of reflectarray tiles, each frame element including a reflector interface having one or more electrical interconnects to provide power and one or more control signals to an associated reflectarray tile to control a phase reflection of the associated reflectarray tile; and an illumination source configured to illuminate at least a portion of the conformal reflectarray; and wherein each frame element of the plurality of frame elements is modular such that selected frame elements may be added to or removed from the frame to accommodate a selected number of reflectarray tiles.

18. The apparatus of claim 17, wherein each reflectarray tile includes a plurality of reflective element cells arranged in a matrix to receive signals within a selected frequency band.

19. The apparatus of claim 17, wherein each reflectarray tile includes a plurality of layers, each layer including a plurality of reflective element cells arranged in a matrix, the reflectarray tile configured to receive signals within multiple frequency bands.

20. The apparatus of claim 17, wherein the surface includes an exterior surface of at least one of a terrestrial vehicle and an aircraft.

* * * * *